US011312515B2

(12) United States Patent
Fujii

(10) Patent No.: US 11,312,515 B2
(45) **Date of Patent: *Apr. 26, 2022**

(54) MEDICINE PACKAGING APPARATUS AND MEDICINE FEEDING APPARATUS

(71) Applicant: Takazono Technology Incorporated, Hirakata (JP)

(72) Inventor: Takayuki Fujii, Hirakata (JP)

(73) Assignee: Takazono Technology Incorporated, Osaka (JP)

( * ) Notice: Subject to any disclaimer, the term of this patent is extended or adjusted under 35 U.S.C. 154(b) by 105 days.

This patent is subject to a terminal disclaimer.

(21) Appl. No.: 16/889,866

(22) Filed: Jun. 2, 2020

(65) Prior Publication Data

US 2020/0290757 A1 Sep. 17, 2020

Related U.S. Application Data

(63) Continuation of application No. 15/740,083, filed as application No. PCT/JP2016/069426 on Jun. 30, 2016, now Pat. No. 10,703,517.

(30) Foreign Application Priority Data

Jul. 2, 2015 (JP) ..... 2015-133399

(51) Int. Cl.
*B65B 5/06* (2006.01)
*B65B 1/30* (2006.01)
(Continued)

(52) U.S. Cl.
CPC ..... *B65B 5/06* (2013.01); *A61J 7/0084* (2013.01); *B65B 1/30* (2013.01); *B65B 5/103* (2013.01);
(Continued)

(58) Field of Classification Search
CPC .. B65B 1/30; B65B 5/06; B65B 5/067; B65B 5/103; B65B 35/08; B65B 35/26;
(Continued)

(56) References Cited

U.S. PATENT DOCUMENTS 3,237,749 A 3/1966 Dudas
3,563,410 A 2/1971 Murray
(Continued)

FOREIGN PATENT DOCUMENTS

CN 103260580 A 8/2013
CN 103735415 A 4/2014
(Continued)

OTHER PUBLICATIONS

Japanese Office Action 2015133399 dated May 10, 2019.

*Primary Examiner* — Stephen F. Gerrity
(74) *Attorney, Agent, or Firm* — The Webb Law Firm

(57) ABSTRACT

A medicine packaging apparatus configured to package medicine based on prescription data, including: a feeder configured to feed solid medicine; a storage configured to temporarily store the solid medicine fed from the feeder; and a packaging unit configured to package the solid medicine discharged from the storage, wherein the storage includes: a plurality of storage containers; a holding table configured to hold the plurality of storage containers so as to be individually detachable; and a drive unit configured to drive the holding table to move so that each of the plurality of storage containers held by the holding table is moved between an introduction position where the solid medicine is introduced from the feeder and a discharge position where the solid medicine is discharged to the packaging unit.

5 Claims, 18 Drawing Sheets

(51) Int. Cl.

| | |
|---|---|
| ***G07F 11/00*** | (2006.01) |
| ***G07F 17/00*** | (2006.01) |
| ***B65B 5/10*** | (2006.01) |
| ***B65B 35/46*** | (2006.01) |
| ***B65B 57/10*** | (2006.01) |
| ***A61J 7/00*** | (2006.01) |

(52) U.S. Cl.
CPC ..... *B65B 35/46* (2013.01); *B65B 57/10* (2013.01); *G07F 11/00* (2013.01); *G07F 17/0092* (2013.01)

(58) Field of Classification Search
CPC ..... B65B 35/46; B65B 39/00; B65B 39/002; B65B 55/24; B65B 57/10; B65B 2210/06; B65B 2210/08; A61J 7/0084; G07F 11/00; G07F 17/0092
USPC ..... 53/154, 562, 568
See application file for complete search history.

(56) References Cited

U.S. PATENT DOCUMENTS

| | | | | |
|---|---|---|---|---|
| 5,010,929 | A | | 4/1991 | Tisma |
| 5,752,368 | A | | 5/1998 | Tobe |
| 6,792,736 | B1 | | 9/2004 | Takahashi et al. |
| 8,234,838 | B2 | | 8/2012 | Yasunaga et al. |
| 9,186,301 | B2 | | 11/2015 | Omura et al. |
| 9,776,755 | B2 | | 10/2017 | Kondo et al. |
| 10,052,260 | B2 | | 8/2018 | Omura et al. |
| 10,239,699 | B2 | * | 3/2019 | Fujii ..... G07F 17/0092 |
| 10,703,517 | B2 | * | 7/2020 | Fujii ..... B65B 1/30 |
| 2009/0255952 | A1 | | 10/2009 | Asaoka et al. |
| 2012/0216485 | A1 | | 8/2012 | Amano et al. |
| 2013/0270291 | A1 | | 10/2013 | Omura et al. |
| 2014/0318078 | A1 | | 10/2014 | Kondo et al. |
| 2017/0305589 | A1 | | 10/2017 | Yuyama et al. |
| 2018/0170591 | A1 | | 6/2018 | Koike et al. |

FOREIGN PATENT DOCUMENTS

| | | | | | |
|---|---|---|---|---|---|
| CN | 104066415 | A | | 9/2014 | |
| GB | 376979 | A | * | 7/1932 | ..... B65B 39/002 |
| JP | 2001129058 | A | | 5/2001 | |
| JP | 201563346 | A | | 4/2015 | |
| WO | 2012086270 | A1 | | 6/2012 | |
| WO | 2013105198 | A1 | | 7/2013 | |

* cited by examiner

MEDICINE PACKAGING APPARATUS AND MEDICINE FEEDING APPARATUS

CROSS-REFERENCE TO RELATED APPLICATIONS

This application is a continuation of U.S. patent application Ser. No. 15/740,083, filed on Dec. 27, 2017, which is the U.S. national phase of International Application No. PCT/JP2016/069426 filed Jun. 30, 2016, and claims priority to Japanese Patent Application No. 2015-133399 filed Jul. 2, 2015, the disclosures of each of which are hereby incorporated by reference in their entireties.

FIELD

The present invention relates to a medicine packaging apparatus configured to package medicine based on prescription data and to a medicine feeding apparatus.

BACKGROUND

Conventionally, there are medicine packaging apparatuses configured to package medicine based on prescription data. For example, a medicine packaging apparatus disclosed in Patent Literature 1 can be mentioned. The medicine packaging apparatus disclosed in Patent Literature 1 includes a monitoring container configured to receive solid medicine discharged from a tablet case and performs image monitoring in the monitoring container. After the monitoring, the solid medicine discharged from the monitoring container is packaged.

As the solid medicine is fed to the monitoring container, medicine powder occurs, for example, due to the solid medicine being shaved off by abutting the medicine feeding path to the monitoring container. The medicine powder accumulates in the monitoring container.

The monitoring container disclosed in Patent Literature 1 is fixed to a rotating turn table. Therefore, it has been difficult to clean away the medicine powder accumulated in the monitoring container. The medicine powder that could not be removed from the monitoring container by cleaning may thus possibly cause mixing (contamination) of different types of medicine that are out of prescription, which is not preferable.

CITATION LIST

Patent Literature

Patent Literature 1: WO 2013/105198 A

SUMMARY

Technical Problem

It is therefore an object of the present invention to provide a medicine packaging apparatus and a medicine feeding apparatus which are capable of facilitating the cleaning.

Solution to Problem

An example of the configuration of the present invention is a medicine packaging apparatus configured to package medicine based on prescription data, the medicine packaging apparatus including: a feeder configured to feed solid medicine; a storage configured to temporarily store the solid medicine fed from the feeder; and a packaging unit configured to package the solid medicine discharged from the storage, wherein the storage includes: a plurality of storage containers; a holding table configured to hold the plurality of storage containers so as to be individually detachable; and a drive unit configured to drive the holding table to move so that each of the plurality of storage containers held by the holding table is moved between an introduction position where the solid medicine is introduced from the feeder and a discharge position where the solid medicine is discharged to the packaging unit.

Further, the configuration can be such that each of the plurality of storage containers includes a bottom part that is movable between an open state in which downward communication is possible and a closing state in which the communication is impossible; and a maintaining unit configured to maintain the bottom part in the closing state when each of the plurality of storage containers is detached from the holding table.

Further, the configuration can be such that the maintaining unit includes a biasing part configured to bias the bottom part toward a direction so as to be in the closing state.

Further, the configuration can be such that each of the plurality of storage containers includes an opening that is open upward, and each of the plurality of storage containers is detached from the holding table with the opening facing upward.

Further, the configuration can be such that each of the plurality of storage containers is configured to be held in an engaged state with the holding table and includes a pair of operation pieces that are located on both sides with the opening being interposed therebetween and are operated by an operator so as to be pinched from both sides inwardly of the opening, and the engaged state of the storage container with the holding table is released by the operation of the pair of operation pieces.

Further, the configuration can be such that the feeder, the storage, and the packaging unit are arranged sequentially from the top, the storage is drawable in the horizontal direction from a housing, and each of the plurality of storage containers is detached from the holding table by being moved upwardly.

Further, an example of the configuration of the present invention is a medicine feeding apparatus configured to feed medicine based on prescription data, the medicine feeding apparatus including: a feeder configured to feed solid medicine; and a storage configured to temporarily store the solid medicine fed from the feeder, wherein the storage includes: a plurality of storage containers; a holding table configured to hold the plurality of storage containers so as to be individually detachable; and a drive unit configured to drive the holding table to move so that each of the plurality of storage containers held by the holding table is moved between an introduction position where the solid medicine is introduced from the feeder and a discharge position where the solid medicine is discharged.

DESCRIPTION OF EMBODIMENTS

Next, the present invention will be described with reference to an embodiment. In the following description, the vertical direction corresponds to the vertical direction in FIG. 1.

Overview

Figure 1:
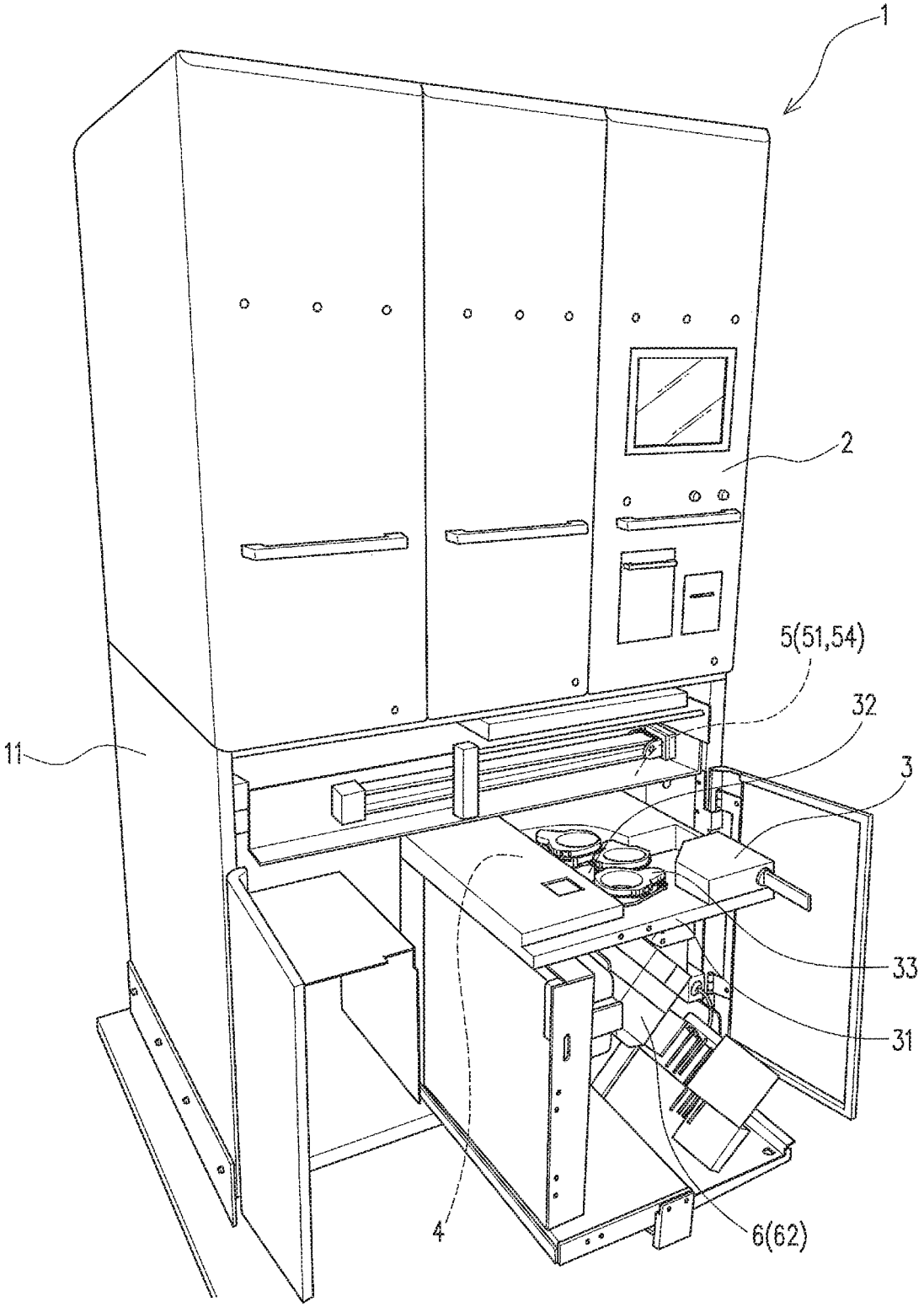
FIG. 1 is a perspective view showing a medicine packaging apparatus according to an embodiment of the present invention.
Figure 2A:
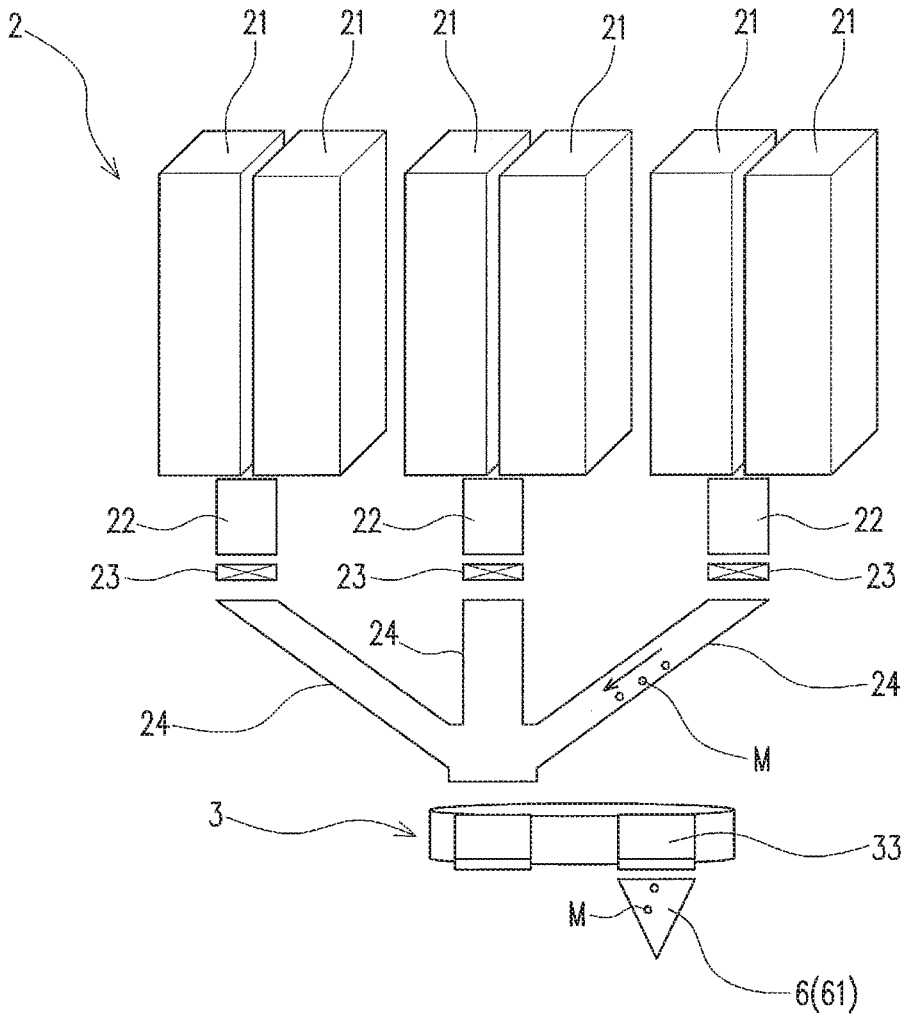
FIG. 2A is a schematic view showing an internal structure of the medicine packaging apparatus.

A medicine packaging apparatus 1 of this embodiment is used for packaging solid medicine M, for example, while being arranged on a horizontal plane, and includes a feeder 2, a storage 3, a storage container detecting unit 4, a monitoring unit 5, and a packaging unit 6. Among these, the feeder 2, the storage 3, and the packaging unit 6 are arranged within a housing 11 from the top in this order. Further, the feeder 2 and the storage 3 constitute a medicine feeding apparatus. FIG. 1 shows the appearance (in the state where the storage 3, a part of the storage container detecting unit 4, a part of the monitoring unit 5, and the packaging unit 6 are drawn out of the housing 11), and FIG. 2A schematically shows the internal structure. Elements belonging to each part are not completely separated, and some elements belong to two or more of the aforementioned parts as described below.

The solid medicine M in this embodiment is in the form that can be separated one by one so that image monitoring (to confirm whether or not the solid medicine M that matches prescription data is present using an image) is possible and is individual medicine that patients can directly take. Examples of the solid medicine M include tablets and capsules, but there is no limitation to these examples. Further, the individual solid medicine M includes each piece resulting from dividing a tablet into half or fractions.

The feeder 2 feeds the solid medicine M to the storage 3. This embodiment is configured so that the solid medicine M is fed by being dropped, but it also can be fed by movements other than dropping.

The feeder 2 of this embodiment includes racks 21, rack chutes 22, rack valves 23, and hopper chutes 24, sequentially from the top. A plurality of racks 21 are provided, and a plurality of cassettes (not shown) are aligned, for example, in the vertical and horizontal directions to be housed in each of the racks 21. FIG. 2A shows an example in which six columns of racks 21 are provided, but there is no limitation to this example, and the number of columns of racks can be variously changed. A plurality of pieces of solid medicine M are housed in each of the cassettes. Based on prescription data, the necessary types and quantity of solid medicine M for packaging are taken out of one or a plurality of cassettes. Each of the rack chutes 22 is a path that is provided corresponding to a plurality (two columns in this embodiment) of racks 21 and is configured to allow the solid medicine M to pass therethrough and introduce the solid medicine M taken out of the cassettes downwardly. The rack valves 23 control the feeding of the solid medicine M to the storage 3. The rack valves 23 are located, for example, at the lower ends of the rack chutes 22 and are configured to open and close the paths through which the solid medicine M pass. The positions of the rack valves 23 with respect to the rack chutes 22 and the hopper chutes 24 are not limited. The hopper chutes 24 connect the rack valves 23 to the storage 3. The hopper chutes 24 are paths that have upper ends connected to the plurality of rack valves 23 and lower parts integrated into one, with its lower end open, and are configured to allow the solid medicine M to pass therethrough, and feed the solid medicine M that has passed through the plurality of rack chutes 22 to the storage 3.

The storage 3 receives the solid medicine M fed from the feeder 2. The storage 3 temporarily stores the solid medicine M. In this embodiment, the solid medicine M is put from the feeder 2 into the storage 3 at an introduction position P1 shown in FIG. 2B and FIG. 3. The solid medicine M is discharged from the storage 3 to the packaging unit 6 at a discharge position P3 after the storage 3 rotates clockwise in planer view, which is in a direction D32 shown by the arrows in FIG. 2B and FIG. 3. The detailed configuration of the storage 3 will be described later.

The storage container detecting unit 4 performs detection for driving a drive unit 35 to rotate a holding table 32 and detection for determining whether or not each storage container 33 (each of a plurality of storage containers 33) is normally held by the holding table 32. It is also possible to perform one of the two detections. The detailed configuration of the storage container detecting unit 4 will be described later.

The monitoring unit 5 monitors the solid medicine M fed from the feeder 2. In this embodiment, monitoring is performed using an image captured, for example, at a shooting position P2 shown in FIG. 2B and FIG. 3. The detailed configuration of the monitoring unit 5 will be described later.

The packaging unit 6 packages the solid medicine M, using a packaging material, discharged from the storage 3 and monitored at the monitoring unit 5. The packaging unit 6 includes a hopper 61 configured to receive the solid medicine M dropped from the storage 3, and a packaging mechanism 62. In the packaging mechanism 62 of this embodiment, a rolled packaging sheet which is drawn out and half-folded in the width direction is located in the opening at the lower end of the hopper 61. Thereby, the solid medicine M based on prescription data is arranged within the half-folded packaging sheet. Thereafter, the packaging sheet is bonded to form a medicine package. An example of the bonding is heat sealing. The packaging unit 6 may be configured to fill a container with the solid medicine M. An example of the container is a vial container.

Storage

Figure 3:
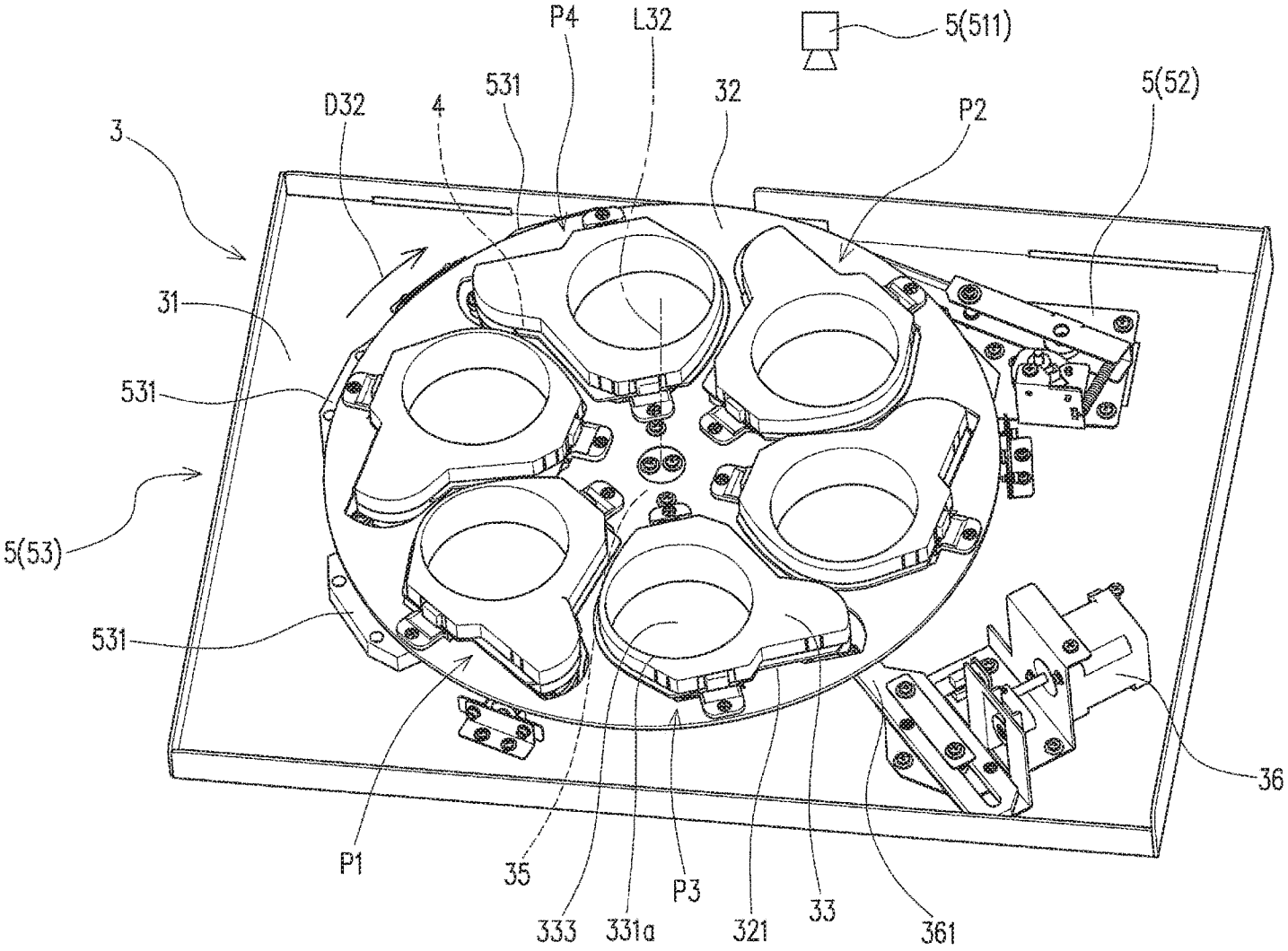
FIG. 3 is a perspective view showing the storage of the medicine packaging apparatus in the state where a cover is omitted.

The storage 3 of this embodiment is in the form shown in FIG. 3 and includes a base 31, the holding table 32, the storage containers 33, the drive unit 35, and a stored medicine discharging unit 36.

Base

The base 31 is a substantially rectangular plate part in planer view and is configured to be drawable forward out of the housing 11 of the medicine packaging apparatus 1, as shown in FIG. 1. To the base 31, the holding table 32, the drive unit 35, and the respective parts of the storage container detecting unit 4 and the monitoring unit 5, which will be described below, are assembled.

Holding Table

The holding table 32 is composed of a flat plate and is provided to be movable in the horizontal direction with respect to the base 31. The holding table 32 is circular in planer view. The holding table 32 has a holding table rotation axis L32 that is a predetermined axis in the base 31. The holding table 32 is provided rotatably about the holding table rotation axis L32. The holding table rotation axis L32 is an axis that is orthogonal to the plane direction at the center of the holding table 32 and extends in the vertical direction. The holding table 32 is rotated clockwise (direction D32) in planer view by the drive unit 35. The rotation is intermittent.

Figure 2B:
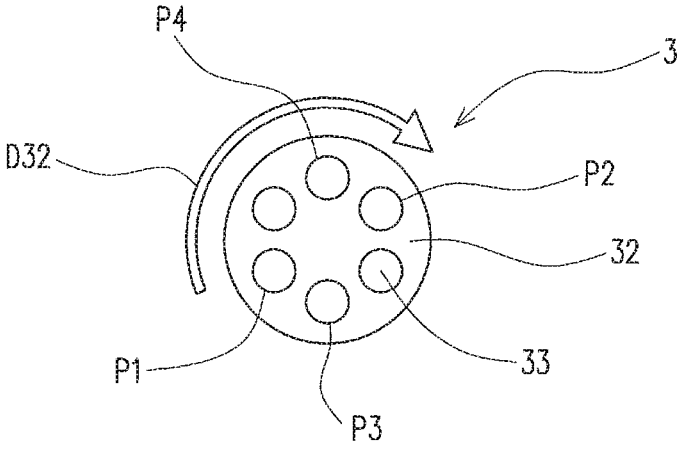
FIG. 2B is a schematic view in planer view showing a holding table of a storage of the medicine packaging apparatus.

The holding table 32 includes a plurality of storage container holding parts 321 configured to hold the plurality of storage containers 33. Six through holes are formed through the holding table 32 of this embodiment, and the respective through holes serve as the storage container holding parts 321. The storage containers 33 are respectively fitted into the storage container holding parts 321, which thereby hold the six storage containers 33. The number of storage containers 33 held by the holding table 32 is not limited, and at least one storage container 33 may be held. With the intermittent rotation of the holding table 32, one of the six storage containers 33 is located at the introduction position P1 that is immediately below the opening at the lower end of the hopper chutes of the feeder 2, as shown in FIG. 2B and FIG. 3. At the same time, another one is located at the discharge position P3 that is immediately above the hopper of the packaging unit 6. Further, at the same time, still another one is located at the shooting position P2 corresponding to an imaging unit 51 of the monitoring unit 5, which will be described below. Further, at the same time, still another one is located at a detection position P4 corresponding to a detection unit (sensor 42) of the storage container detecting unit 4.

The storage container holding parts 321 respectively hold the storage containers 33 so as to be detachable. The through holes serving as the plurality of storage container holding parts 321 are formed at intervals from each other on the circumference with the holding table rotation axis L32 serving as the center. The intervals are set to be equal (at equal angles with reference to the holding table rotation axis L32) in the circumferential direction. Therefore, the holding table 32 holds the plurality of storage containers 33 at equal intervals on the same horizontal plane. The holding table 32 holds the plurality of storage containers 33 at intervals from each other on the circumference with the holding table rotation axis L32 serving as the center.

Storage Containers

Figure 4:
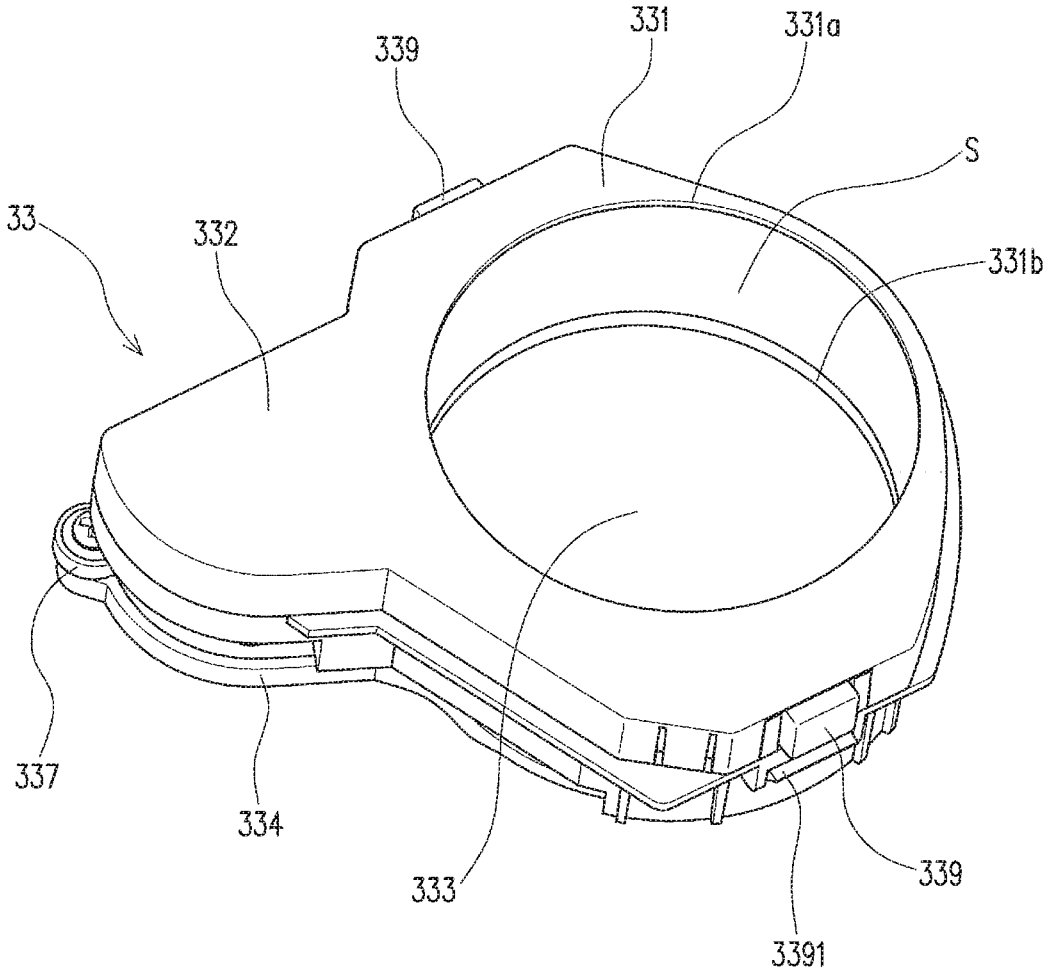
FIG. 4 is a perspective view showing a storage container of the medicine packaging apparatus.

The storage containers 33 are in the form shown in FIG. 4 and are configured to receive the solid medicine M fed from the feeder 2 and temporarily store it. The storage containers 33 are configured to be capable of dropping the stored solid medicine M into the packaging unit 6, as needed. Each of the storage containers 33 includes a frame 331, and a bottom part 333 located below the frame 331 and configured to be movable with respect to the frame 331. The frame 331 of the storage container 33 is held by the corresponding storage container holding part 321 of the holding table 32. Therefore, the storage container 33 is held by the holding table 32 at an intermediate position in the vertical direction. Therefore, as shown in FIG. 3, the lower part of the storage container 33 is embedded in the holding table 32, and thus the vertical dimension of the medicine packaging apparatus 1 can be reduced.

Figure 5:
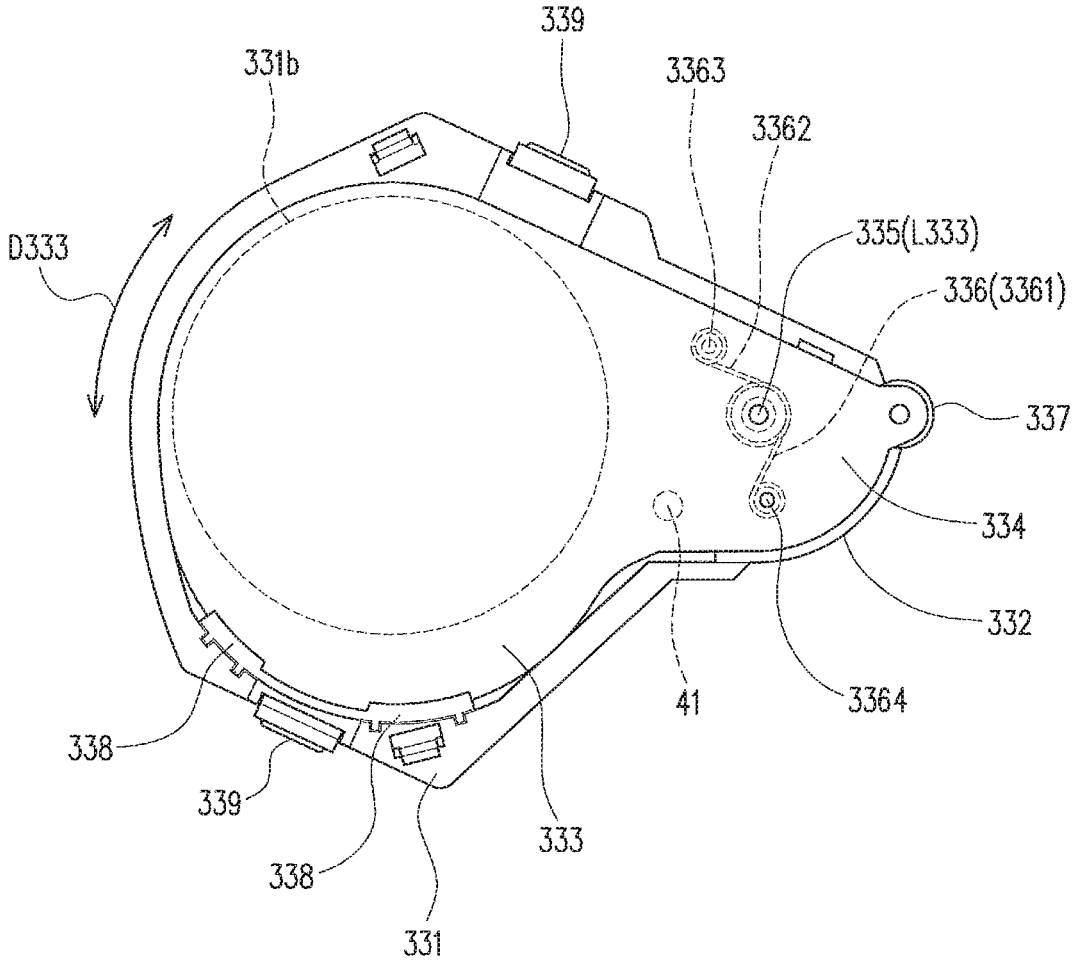
FIG. 5 is a bottom view showing the storage container of the medicine packaging apparatus in a closing state.
Figure 6:
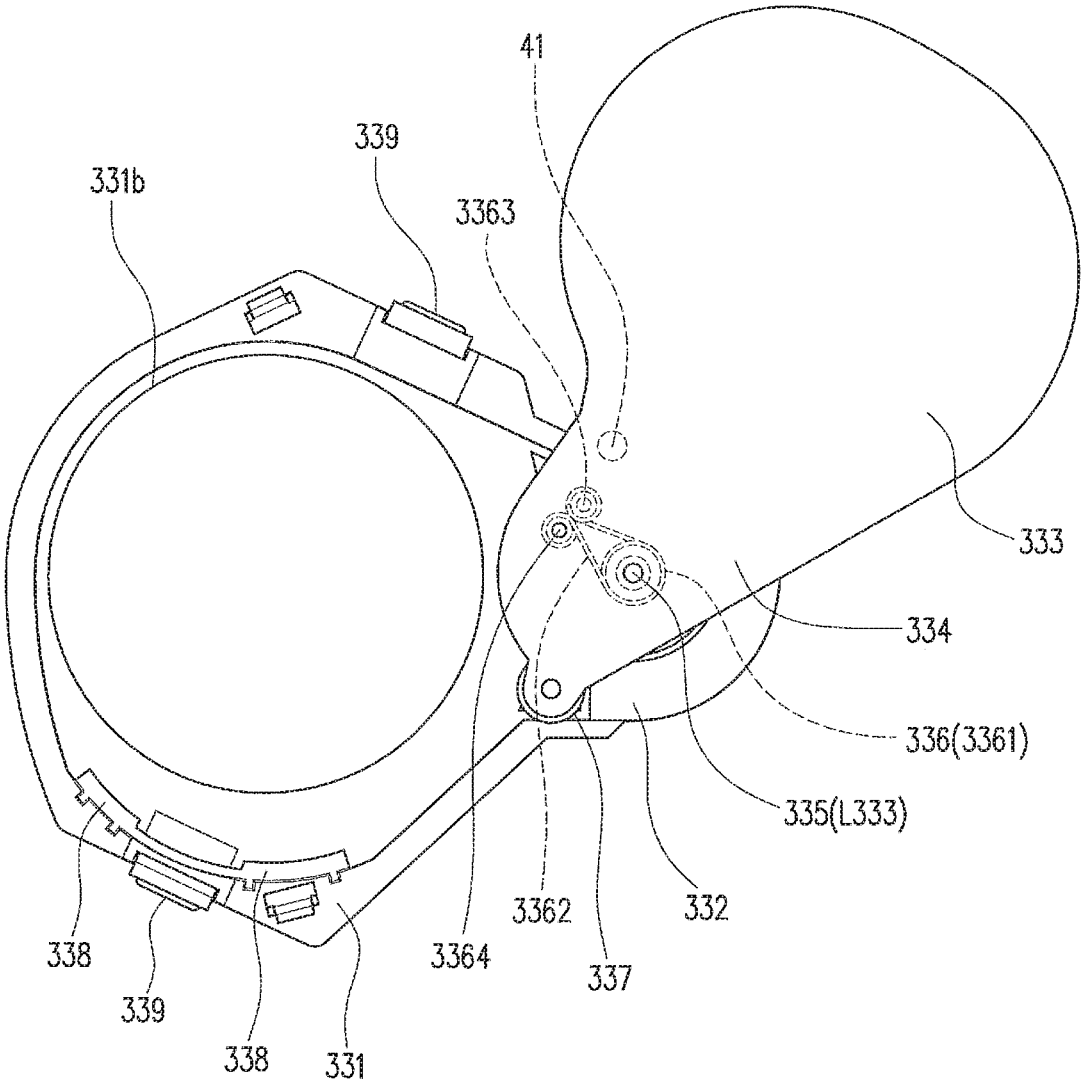
FIG. 6 is a bottom view showing the storage container of the medicine packaging apparatus in an open state.

The frame 331 forms a storage space S configured to store the solid medicine M in cooperation with the bottom part 333. Therefore, the upper end and the lower end of the frame 331 are open. The opening shape is circular in plan view. An upper opening 331*a* of the frame 331 is constantly open so as to introduce the solid medicine M fed from the feeder 2 into the storage container 33. On the other hand, a lower opening 331*b* can be opened and closed by the bottom part 333. The opening and closing direction is the horizontal direction. The bottom part 333 is movable between an open state in which downward communication is possible and a closing state in which the communication is impossible (FIG. 5 shows the closing state, and FIG. 6 shows the open state) for the opening and closing. By the opening of the bottom part 333, the solid medicine M can be dropped through the lower opening 331*b* of the frame 331 to be discharged from the storage container 33. The bottom part 333 moves parallel to the lower opening 331*b* of the frame 331. Accordingly, the solid medicine M on the bottom part 333 can be swept by the inner surface of the lower opening 331*b* of the frame 331, and therefore the solid medicine M can be reliably discharged from the storage container 33 by moving the solid medicine M. The bottom part 333 is supported so as to be pivotable in a direction D333 shown in FIG. 5 within a specific range with respect to the lower surface of the frame 331. Therefore, the bottom part 333 can be reciprocally moved in specific directions (vibration directions) by vibration mechanisms 52 and 53, which will be described below. In this embodiment, when the bottom part 333 pivots 10° or more about an axial center (which coincides with a bottom-part pivot axis L333) of a coupler 335, the open state is established. The bottom part 333 of this embodiment pivots up to 90°.

The bottom part 333 can be moved with respect to the frame 331 while maintaining the closing state so that the solid medicine M is not dropped. Specifically, as shown in FIG. 5, the bottom part 333 is formed within a range including an oval having a major diameter larger than the opening shape (shown by a dashed line in the figure) of the circle (specifically, perfect circle) of the frame 331. The reciprocal movement of the bottom part 333 in the direction of the major diameter can prevent the lower opening 331*b* from being opened even in the reciprocal movement, and therefore the bottom part 333 can maintain the closing state (the state where the lower opening 331*b* is closed). In this embodiment, even if the bottom part 333 pivots less than 10° about the axial center (the bottom-part pivot axis L333) of the coupler 335, the closing state can be maintained.

The bottom part 333 can hold the solid medicine M in the storage space S (specifically, on the upper surface of the bottom part 333) when the lower opening 331*b* of the frame 331 is closed and can drop the solid medicine M that has been held in the storage space S when it is open. Further, the bottom part 333 can move the solid medicine M by sliding it on the bottom part 333, by being reciprocally moved while maintaining the closing state. Thereby, a plurality of types (pieces) of solid medicine M are separated from each other on the bottom part 333, and therefore the monitoring accuracy by the monitoring unit 5 can be improved.

For the pivotable support, each of the storage containers 33 includes a frame-side extending part 332 and a bottom-side extending part 334. The frame-side extending part 332 is continuous with the frame 331 and horizontally extends outwardly of the frame 331 (in the opposite direction of the storage space S). The bottom-side extending part 334 is continuous with the bottom part 333 and horizontally extends to be opposed to the frame-side extending part 332 at a specific opposing distance downwardly. In this embodiment, the frame 331 and the frame-side extending part 332 are integrally formed, and the bottom part 333 and the bottom-side extending part 334 are integrally formed. The frame-side extending part 332 and the bottom-side extending part 334 are coupled together by the coupler 335 located between the frame-side extending part 332 and the bottom-side extending part 334. The coupler 335 has the bottom-part pivot axis L333. The coupler 335 couples the frame-side extending part 332 and the bottom-side extending part 334 so as to be pivotable about the bottom-part pivot axis L333. That is, the axial center of the coupler 335 coincides with the bottom-part pivot axis L333. The bottom-part pivot axis L333 is a vertical axis. Each of the storage containers 33 includes a biasing part 336 located between the frame-side extending part 332 and the bottom-side extending part 334 and configured to bias the bottom part 333 in the closing direction (direction in which the bottom part 333 is rendered in the closing state). Such configuration of the storage container 33 can reduce the vertical dimension of the storage container 33 so as to reduce the vertical dimension of the medicine packaging apparatus 1.

Further, the biasing part 336 functions as at least a part of a maintaining unit configured to maintain the bottom part 333 in the closing state when the storage container 33 is detached from the holding table 32. Since the maintaining unit includes the biasing part 336 in this way, thereby allowing the bottom part 333 to be maintained in the closing state when the storage container 33 is detached from the holding table 32, the residue remaining in the storage container 33 is less likely to fall down into the medicine packaging apparatus 1. Therefore, the bottom part 333 can be maintained in the closing state with a simple configuration.

Figure 7:
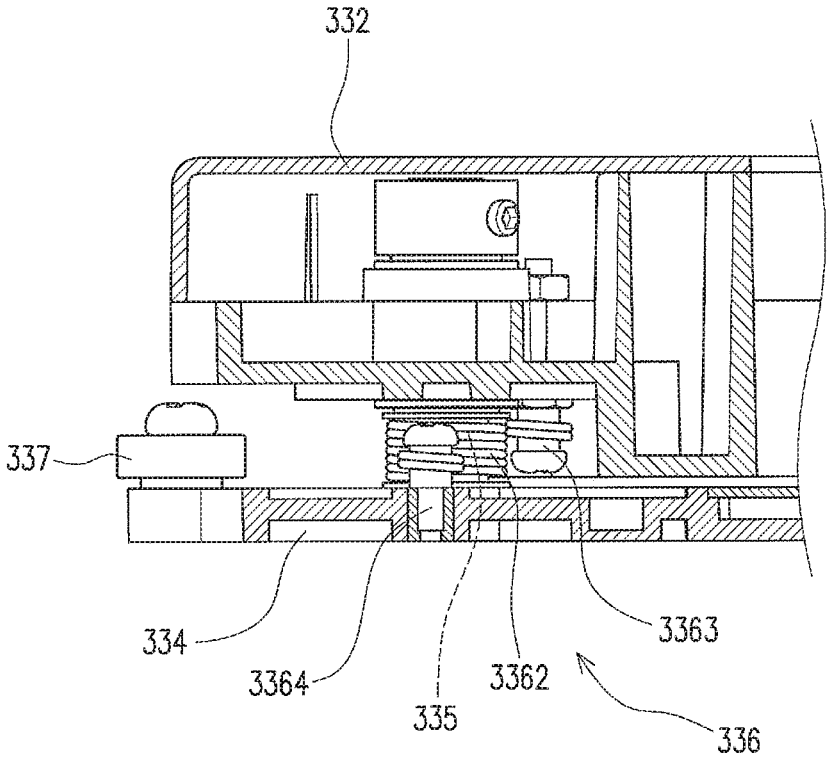
FIG. 7 is a vertical sectional view showing a main part of a biasing part of the storage container of the medicine packaging apparatus.

The biasing part 336 has a coil 3361. As shown in FIG. 7, the coil 3361 includes a torsion coil spring member 3362, a frame-side locking tool 3363, and a bottom-side locking tool 3364. The torsion coil spring member 3362 is attached to the coupler 335. Specifically, the torsion coil spring member 3362 is externally fitted to the coupler 335. The frame-side locking tool 3363 is provided in the frame-side extending part 332 and is configured to engage one end of the torsion coil spring member 3362. The bottom-side locking tool 3364 is provided in the bottom-side extending part 334 and is configured to engage the other end of the torsion coil spring member 3362. The one end of the torsion coil spring member 3362 is attached to the frame-side locking tool 3363 so as not to be disengaged. The other end of the torsion coil spring member 3362 is attached to the bottom-side locking tool 3364 so as not to be disengaged.

For such attachment, head screws are, for example, used as the frame-side locking tool 3363 and the bottom-side locking tool 3364. The one end of the torsion coil spring member 3362 is formed into a ring that is larger than the shank of the frame-side locking tool 3363 and smaller than the head thereof, and the other end of the torsion coil spring member 3362 is formed into a ring that is larger than the shank of the bottom-side locking tool 3364 and smaller than the head thereof, thereby preventing disengagement.

According to these configurations, even if the torsion coil spring member 3362 breaks due to fatigue, fragments generated by the breakage can be rendered as they are, in the state of being attached or caught to any one of the coupler 335, the frame-side locking tool 3363, and the bottom-side locking tool 3364, in most cases. Therefore, the occurrence of foreign matter contamination accident due to the fragments falling down into the packaging unit 6 and being accidentally packaged together with the solid medicine M can be suppressed.

The frame-side locking tool 3363 is provided so as to have a total length larger than the specific opposing distance between the frame-side extending part 332 and the bottom-side extending part 334, to have a part (the part of the shank of the head screw) embedded in the frame-side extending part 332, and to be constantly opposed to the bottom-side extending part 334 even if the lower opening 331*b* is opened or closed by the bottom part 333.

The bottom-side locking tool 3364 is provided so as to have a total length larger than the specific opposing distance between the frame-side extending part 332 and the bottom-side extending part 334, to have a part (the part of the shank of the head screw serving as the frame-side locking tool 3363) embedded in the bottom-side extending part 334, and to be constantly opposed to the frame-side extending part 332 even if the lower opening 331*b* is opened or closed by the bottom part 333.

According to these configurations, the occurrence of foreign matter contamination accident due to the frame-side locking tool 3363 or the bottom-side locking tool 3364 being loosened or the like to be unexpectedly disengaged, falling down into the packaging unit 6, and being accidentally packaged together with the solid medicine M can be suppressed.

Each of the storage containers 33 includes a pressed part 337. The pressed part 337 is formed at the end of the bottom-side extending part 334 on the opposite side of the bottom part 333. The pressed part 337 is pressed by a pressing part 3611 of the stored medicine discharging unit 36 so that the bottom part 333 is moved to open the lower opening 331*b* (for example, in the state shown in FIG. 6). Further, the pressed part 337 is pressed by a pressing part 5211 of the vibration mechanism (first vibration mechanism 52) (see FIG. 13) so that the bottom part 333 is reciprocally moved in the specific vibration directions.

Figure 8A:
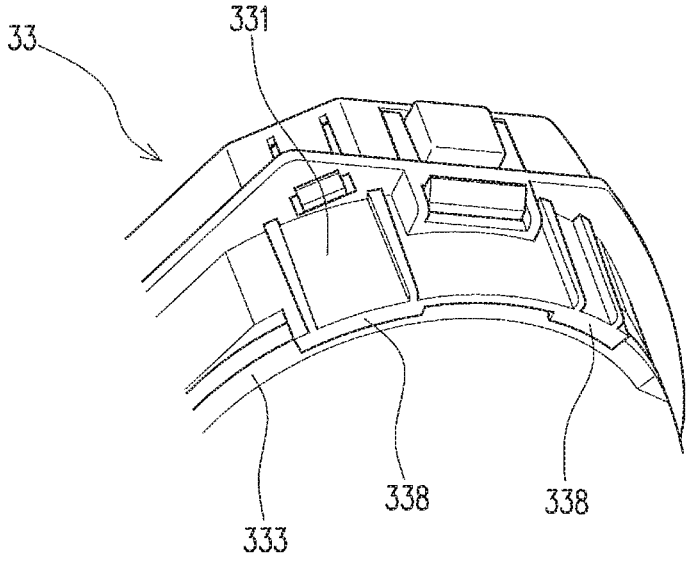
FIG. 8A is a perspective view on the bottom side showing a main part of a support part of the storage container of the medicine packaging apparatus.

Each of the storage containers 33 includes a support part 338 provided between the frame 331 and the bottom part 333 and configured to engage the bottom part 333 to support it from below when the bottom part 333 is in the closing state. Specifically, the support part 338 is formed as a projection projecting inwardly (in the direction facing the storage space S) from the frame 331, as shown in FIG. 8A. Such a configuration can prevent the bottom part 333 from being lowered from the frame 331 and therefore can prevent leakage of the solid medicine M through the gap in the vertical direction between the frame 331 and the bottom part 333.

Figure 8B:
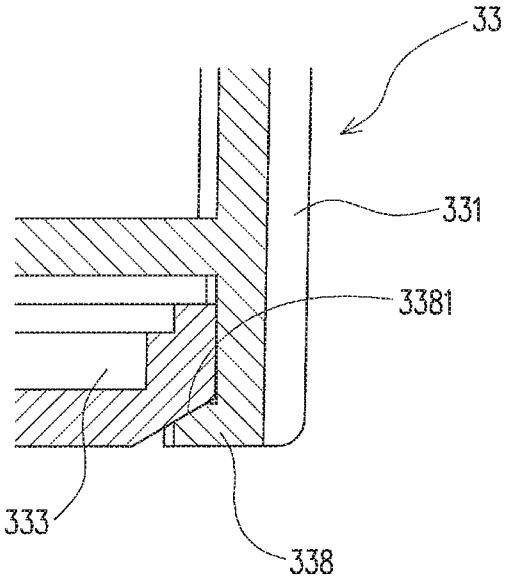
FIG. 8B is a vertical sectional view showing a main part of the support part of the storage container of the medicine packaging apparatus.

The support part 338 includes a guide part 3381 configured to guide the bottom part 333 upwardly as the bottom part 333 travels in the closing direction. Specifically, the guide part 3381 is formed as an inclined surface formed on the top of the support part 338, as shown in FIG. 8B. Such a configuration can reduce the gap in the vertical direction between the frame 331 and the bottom part 333 in the closing state so as to prevent leakage of the solid medicine M.

Figure 9:
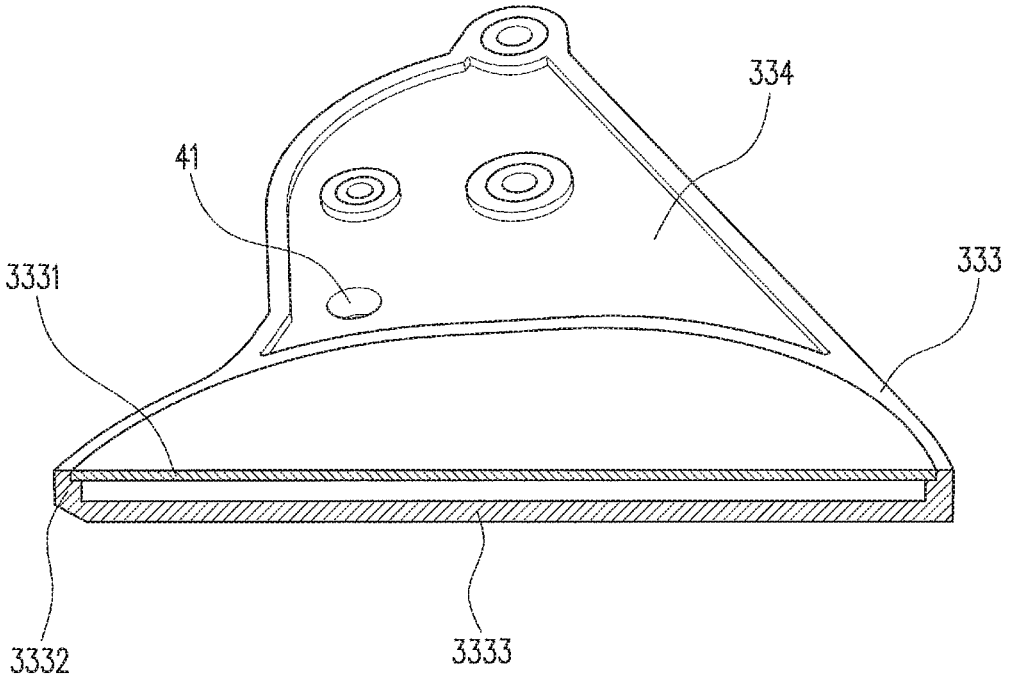
FIG. 9 is a perspective view of the vertical section showing a bottom part of the storage container of the medicine packaging apparatus.

As shown in FIG. 9, the bottom part 333 includes a receiving part 3331 configured to receive the solid medicine M fed by being dropped from the feeder 2. The receiving part 3331 is formed into a thin plate shape. Further, the receiving part 3331 is configured to enable downward elastic deformation. Specifically, the receiving part 3331 is a flat plate made of a resin material. Such a configuration can mitigate the impact of dropping with an inexpensive configuration so as to prevent bounce of the solid medicine M. For at least the upper surface of the receiving part 3331, a color that facilitates image monitoring can be employed.

The bottom part 333 includes a holding part 3332 configured to hold the circumferential edge of the receiving part 3331. Specifically, the holding part 3332 is formed as a step configured to coincide with the circumferential edge of the bottom part 333, and the receiving part 3331 is fitted into the holding part 3332 that is the step. The circumferential edge of the receiving part 3331 is fixed by the holding part 3332. Therefore, the shape of the receiving part 3331 can be retained by the holding part 3332.

The bottom part 333 includes a reinforcing part 3333 configured to reinforce the holding part 3332. The reinforcing part 3333 is continuous with the holding part 3332 and is provided below the receiving part 3331 with a spacing. The reinforcing part 3333 of this embodiment is a flat plate-shaped portion located one step lower than the holding part 3332 that is the step. An air layer that can function as a cushion is formed by the reinforcing part 3333 in an amount of the spacing provided above. The air layer allows elastic deformation of the receiving part 3331 in the vertical direction. Therefore, the holding part 3332 can be reinforced without inhibiting the elastic deformation.

The storage container 33 is detached from the holding table 32 with the upper opening 331*a* that is the opening shown in FIG. 3 facing upward. Therefore, the upper opening 331*a* is not oriented laterally or downward, so that the residue remaining within the storage container 33 does not fall down into the medicine packaging apparatus 1.

Further, the storage container 33 is configured to be held by the holding table 32 in an engaged state. As shown in FIG. 4, the storage container 33 includes operation pieces 339 that are operated inwardly of the upper opening 331*a* that is the opening. A pair of operation pieces 339 are provided so as to be located on both sides with the upper opening 331*a* interposed therebetween. Each of the operation pieces 339 includes a claw 3391 in its lower part, and the claw 3391 engages an edge (more specifically, an engaged member fixed to the edge) of a through hole that is each one of the storage container holding parts 321 of the holding table 32, thereby allowing the storage container 33 to be held by the holding table 32. The pair of operation pieces 339 are operated by an operator so as to be pinched from both sides inwardly of the upper opening 331*a*. When the operation pieces 339 are operated in this way, the claws 3391 also move inwardly, and therefore the engaged state of the storage container 33 with the holding table 32 is released. Since the pair of operation pieces 339 are operated so as to be pinched from both sides inwardly of the upper opening 331*a*, the hand of the operator covers over the upper opening 331*a* when the engagement is released. Accordingly, the upper opening 331*a* is closed by the hand of the operator. Therefore, when the storage container 33 is detached from the holding table 32, the residue remaining within the storage container 33 is further less likely to fall down, and the residue can be reliably collected. The operation pieces 339 are not necessarily provided as a pair and any one of them may be provided alone.

Drive Unit

The drive unit 35 drives the holding table 32 to rotate so as to move the storage containers 33 held by the holding table 32. The movement is horizontal movement. The driving is performed so as to rotate the holding table 32 about the holding table rotation axis L32. The driving is intermittent driving. The drive unit 35 of this embodiment includes a motor, which is not shown, provided on the bottom surface of the base 31, a driving force transmission mechanism such as a gear connected to the motor, and a rotation shaft coinciding with the holding table rotation axis L32 and extending downwardly from the center of the holding table 32. The drive shaft of the motor may be directly connected to the rotation shaft without the intermediation of the driving force transmission mechanism.

As described above, the holding table 32 is rotatably provided, and the drive unit 35 drives the holding table 32 to rotate about the holding table rotation axis L32, with the holding table 32 holding the plurality of storage containers 33 on its circumference, so that the storage containers 33 can be horizontally moved with a simple configuration.

The drive unit 35 moves the storage containers 33 between the introduction position P1 where the solid medicine M is introduced from the feeder 2 and the discharge position P3 where the solid medicine M is discharged to the packaging unit 6. The storage containers 33 are sequentially moved to the discharge position P3 by the drive unit 35 that performs the intermittent driving.

The drive unit 35 rotates the holding table 32 so that the storage containers 33 are moved in one direction and are stopped at a plurality (six points in this embodiment) of stop positions in the course of the movement. The plurality of stop positions include the introduction position P1, the discharge position P3, the shooting position P2 which is provided between the introduction position P1 and the discharge position P3 and at which an image of the solid medicine M is captured by the imaging unit 51, which will be described below, and a plurality (two points in this embodiment) of intermediate stop positions provided between the introduction position P1 and the shooting position P2. The detection position P4, which will be described below, is one of the intermediate stop positions. Further, one intermediate stop position is provided between the shooting position P2 and the discharge position P3. This is for ensuring the time in a determination unit 54 of the monitoring unit 5 to process the image of the medicine M captured at the shooting position P2. Further, this is also for stopping the operation of the medicine packaging apparatus 1 before the solid medicine M is discharged from the storage container 33, if the solid medicine M within the storage container 33 is different from the prescription data, as a result of the determination by the determination unit 54 of the monitoring unit 5. By stopping the operation of the medicine packaging apparatus 1 before the solid medicine M is discharged from the storage container 33, it is possible to prevent the solid medicine M that is different from the prescription data from being packaged.

Stored Medicine Discharging Unit

Figure 10:
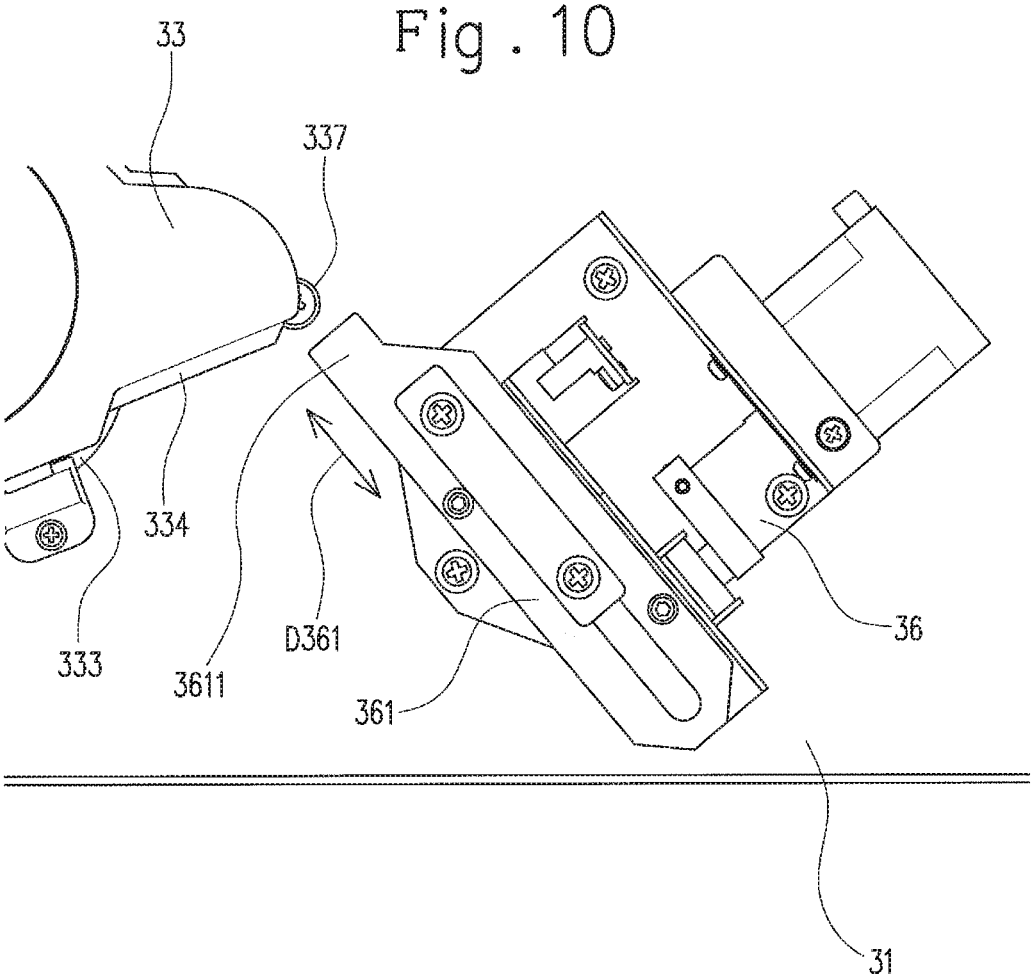
FIG. 10 is a plan view showing a stored medicine discharging unit of the medicine packaging apparatus.

As shown in FIG. 10, the stored medicine discharging unit 36 is provided on the base 31 and includes a rod-shaped part 361 configured to reciprocally move in a longitudinal direction D361. The pressing part 3611 located at the distal end of the rod-shaped part 361 presses the pressed part 337 of the storage container 33, thereby allowing the bottom part 333 and the bottom-side extending part 334 to move to the state shown in FIG. 6 so as to open the lower opening 331*b* of the frame 331, so that the solid medicine M can be dropped into the packaging unit 6.

Summary of Storage

As shown in FIG. 1, the storage 3 configured as above can be drawn in the horizontal direction from the housing 11. Each of the storage containers 33 is detached from the holding table 32 by being moved upwardly. Since the storage 3 is located at an intermediate position in the vertical direction, which is not excessively high or low, in the medicine packaging apparatus 1, it is easy for the operator to draw the storage 3 and to attach and detach the storage container 33. Therefore, cleaning of the storage containers 33 can be facilitated.

According to the storage 3 configured as above, the storage containers 33 can be individually attached or detached, and the storage containers 33 can be cleaned in the detached state. Therefore, cleaning of the storage containers 33 can be facilitated.

Storage Container Detecting Unit

Figure 11:
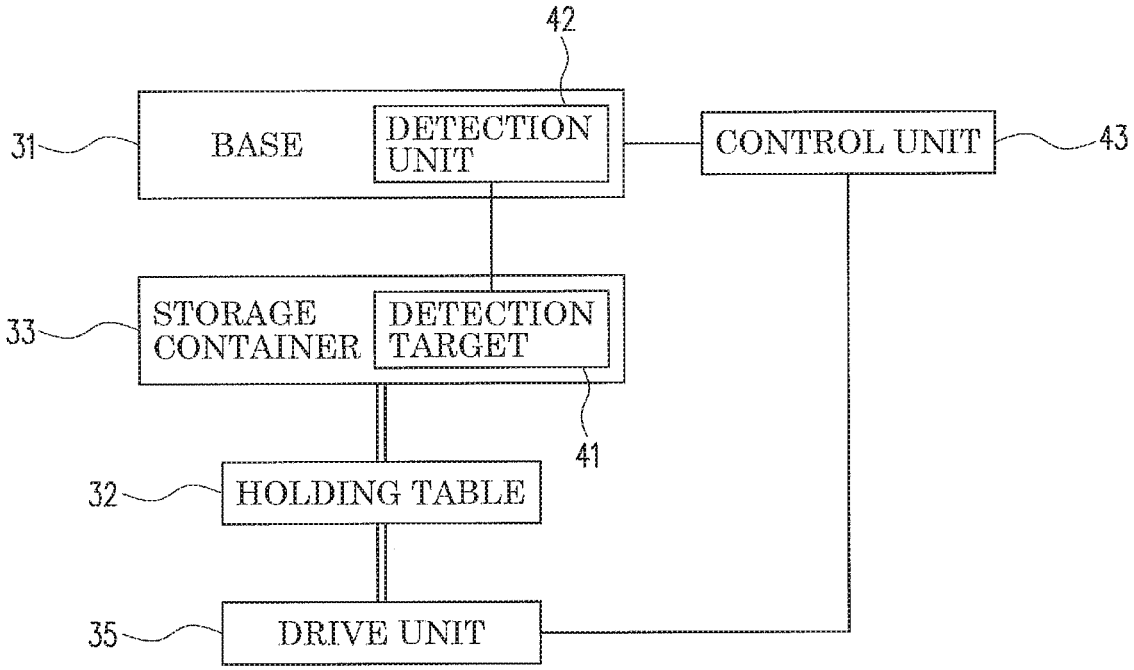
FIG. 11 is a block diagram showing a storage container detecting unit of the medicine packaging apparatus.

The storage container detecting unit (medicine storage device) 4 includes the base (31), the holding table (32), the storage container (33), the drive unit (35), a detection target 41, the sensor 42 serving as the detection unit, and a control unit 43. A schematic block diagram is shown in FIG. 11. The holding table (32), the storage container (33), and the drive unit (35) also belong to the storage 3, as described above (overlapping descriptions for these components belonging also to the storage 3 are omitted herein).

Detection Target

The detection target 41 is provided in each of the storage containers 33. In this embodiment, one detection target 41 is provided for each of the storage containers 33. The detection target 41 of this embodiment includes a permanent magnet.

The detection target 41 is provided in the bottom part 333 capable of opening and closing the lower opening 331*b* of the storage container 33 or the bottom-side extending part 334 that is integrated with the bottom part 333. As shown by the dashed line in FIG. 5, the detection target 41 of this embodiment is provided in the bottom-side extending part 334. Therefore, when the bottom part 333 is in the closing state, detection can be made by the sensor 42 provided on the base 31. On the other hand, when the bottom part 333 is in the open state, the detection target 41 moves and is therefore undetectable by the sensor 42. According to this configuration, even if the storage container 33 is held by the holding table 32, it can be determined that the storage container 33 is not normally held by the holding table 32 when the bottom part 333 of the storage container 33 is in the open state.

Detection Unit

Figure 12:
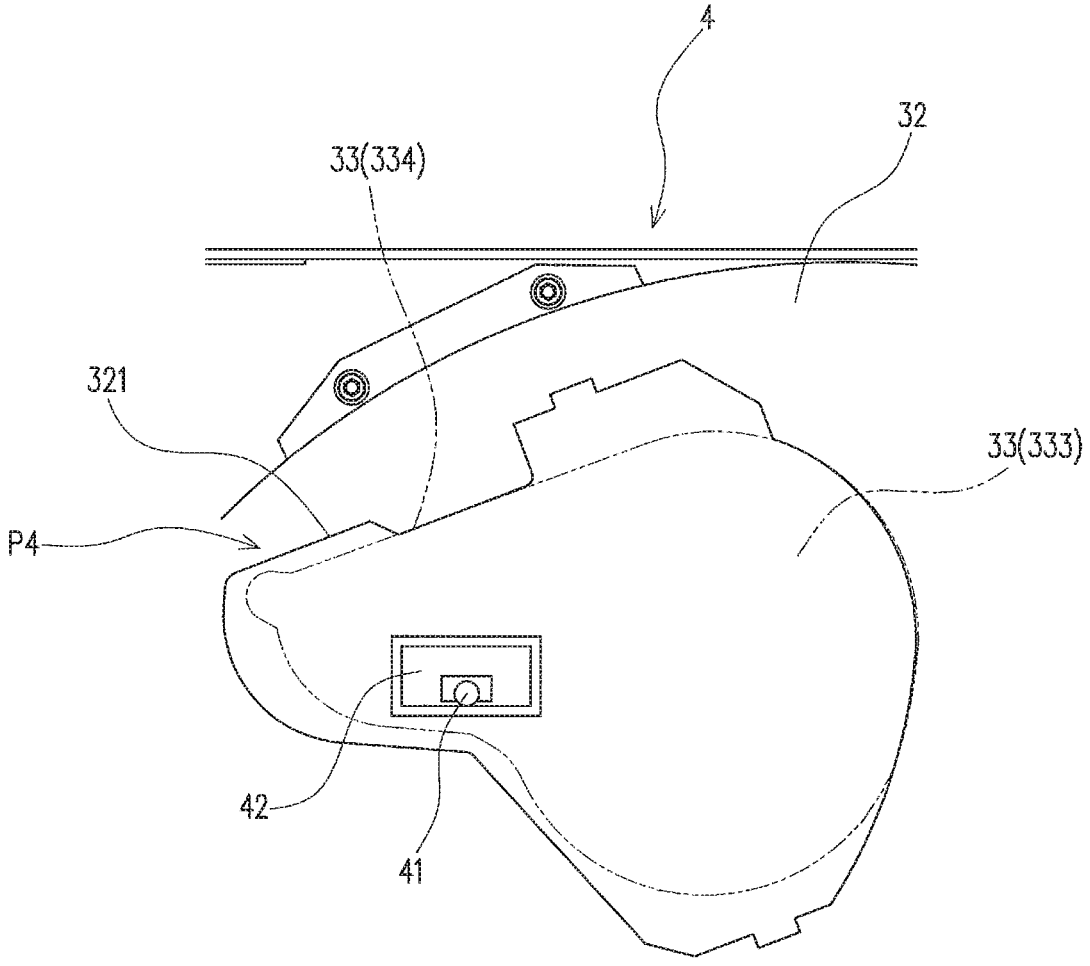
FIG. 12 is a plan view showing the storage container detecting unit of the medicine packaging apparatus.

As shown in FIG. 12, the sensor 42 serving as the detection unit is provided at a position vertically opposed to the detection target 41 of the storage container 33 (shown by the dashed line) that is located at the detection position P4 on the base 31. The sensor 42 detects the detection target 41 of the storage container 33 that has arrived at the detection position P4. The detection position P4 is arranged, on the circumference of the holding table 32 on which the plurality of storage containers 33 are held, at a distance that is an integer multiple of the interval between the storage containers 33 from the discharge position P3. Incidentally, the introduction position P1 is also arranged on the circumference at a distance that is an integer multiple of each interval between the storage containers 33 from the discharge position P3. The sensor 42 of this embodiment is a magnetic sensor (hole sensor). Therefore, the detection target 41 and the sensor 42 can be implemented by a general configuration of such combination of the permanent magnet and the magnetic sensor.

Control Unit

The control unit 43 rotates the holding table 32 by the drive unit 35 based on the detection results by the sensor 42. The holding table 32 is rotated so that the storage containers 33 are sequentially moved to the discharge position. Further, the control unit 43 determines whether or not the storage containers 33 are normally held by the holding table 32.

The control unit 43 rotates the holding table 32 by the drive unit 35 so that all the detection targets 41 of the storage containers 33 held by the holding table 32 can be detected by the sensor 42. During the rotation, if all the detection targets 41 of the storage containers 33 could be detected by the sensor 42, it is determined that all the storage containers 33 are normally held by the holding table 32, whereas if any one of the detection targets 41 of the storage containers 33 could not be detected by the sensor 42, it is determined that any one of the plurality of storage containers 33 is not normally held by the holding table 32. Thus, whether or not all the storage containers 33 are normally held by the holding table 32 can be determined.

The control unit 43 can control the normal operation of packaging the solid medicine M and the initial operation that is performed only at the beginning of the driving of the medicine packaging apparatus 1 before the normal operation, as follows.

As an example, the control unit 43 stops the rotation of the holding table 32 by the drive unit 35 if the detection target 41 is detected by the sensor 42 during the rotation of the holding table 32 by the drive unit 35 in the normal operation. Thus, each of the storage containers 33 can be stopped at the discharge position P3.

In the rotation of the holding table 32, the control unit 43 drives the drive unit 35 to rotate the holding table 32 so that the storage containers 33 are moved by at least a specific distance that is equivalent to the intervals between the storage containers 33 on the circumference. During this period, if the detection target 41 could not be detected by the sensor 42, it is determined by the control unit 43 that any one of the plurality of storage containers 33 is not normally held by the holding table 32. Thus, in the normal operation, whether or not the storage containers 33 are normally held by the holding table 32 can be determined.

As another example, the control unit 43 determines whether or not the detection target 41 is detected by the sensor 42 before the holding table 32 is rotated by the drive unit 35, in the normal operation. As a result, if the detection target 41 is detected, the control unit 43 rotates the holding table 32 by the drive unit 35 so that the storage containers 33 held by the holding table 32 are moved by the distance equivalent to the intervals between the storage containers 33 on the circumference. Meanwhile, when the detection target 41 is not detected, the control unit 43 rotates the holding table 32 by the drive unit 35 until the detection target 41 is detected by the sensor 42. Thus, each of the storage containers 33 can be stopped at the discharge position P3 in the normal operation.

In the rotation of the holding table 32, the control unit 43 drives the drive unit 35 to rotate the holding table 32 so that the storage containers 33 are moved by the distance that is equivalent to the intervals between the storage containers 33 on the circumference. Thereafter, whether or not the detection target 41 is detected by the sensor 42 is determined. As a result, if the detection target 41 is not detected, it is determined that any one of the plurality of storage containers 33 is not normally held by the holding table 32. Thus, in the normal operation, whether or not the storage containers 33 are normally held by the holding table 32 can be determined.

Further, the control unit 43 rotates the holding table 32 one round by the drive unit 35 in the initial operation. It is determined that all the storage containers 33 are normally held by the holding table 32 when all (six in this embodiment) the detection targets 41 of the storage containers 33 are detected by the sensor 42 during the period in which the holding table 32 is rotated one round. On the other hand, if any one of the detection targets 41 of the storage containers 33 cannot be detected by the sensor 42, it is determined that any one of the plurality of storage containers 33 is not normally held by the holding table 32. Thus, whether or not all the storage containers 33 are normally held by the holding table 32 can be determined in the initial operation.

Summary of Storage Container Detecting Unit

According to the storage container detecting unit 4 configured as above, the one sensor 42 can serve as both the detection unit for rotating the holding table 32 by the drive unit 35 so that the storage containers 33 held by the holding table 32 are sequentially moved to the discharge position and the detection unit for determining whether or not the storage containers 33 are normally held by the holding table 32. Therefore, whether or not the storage containers 33 are normally mounted on the holding table 32 can be determined, based on the detection results by a small number of detection units (sensor 42). Accordingly, the number of parts constituting the storage container detecting unit 4 can be reduced.

Monitoring Unit

The monitoring unit 5 includes the base (31), the holding table (32), the storage containers (33), the drive unit (35), the imaging unit 51, the vibration mechanisms 52 and 53, and the determination unit 54. The base (31), the holding table (32), the storage containers (33), and the drive unit (35) also belong to the storage 3 and the storage container detecting unit 4, as described above (overlapping descriptions for these components belonging also to the storage 3 and the storage container detecting unit 4 are omitted herein).

Imaging Unit

The imaging unit 51 includes a camera 511 (schematically shown in FIG. 3) and shoots the solid medicine M present in the storage container 33 (the bottom part 333).

The imaging unit 51 is provided at a position where the solid medicine M present in the storage container 33 that has arrived at the shooting position P2 arranged on the circumference at a distance that is an integer multiple of each interval between the storage containers 33 from the discharge position P3, with the rotation of the holding table 32 by the drive unit 35 that is driven by the control unit 43, is shot. Therefore, there is no need to separately provide a detection unit for rotating the holding table 32 by the drive unit 35 (for example, in the storage container detecting unit 4) so that the storage containers 33 held by the holding table 32 are sequentially moved to the shooting position P2. Accordingly, the number of parts constituting the monitoring unit 5 can be reduced.

Vibration Mechanisms

The vibration mechanisms 52 and 53 vibrate the bottom part 333 (and the bottom-side extending part 334) of the storage container 33 before the shooting by the imaging unit 51. The vibration mechanisms 52 and 53 vibrate the bottom part 333 (and the bottom-side extending part 334) of the storage container 33 in the same directions (vibration directions) as the moving directions of the bottom part 333 for opening and closing.

The bottom part 333 of the storage container 33 is vibrated by the vibration mechanisms 52 and 53, so that the solid medicine M can be moved by sliding or rolling on the bottom part 333 of the storage container 33. Thus, the plurality of types (pieces) of solid medicine M can be separated from each other on the bottom part 333. Therefore, the monitoring accuracy can be improved. Moreover, as compared with the case where the bottom part 333 is vibrated in a different direction from the opening and closing direction of the bottom part 333, the bottom part 333 can be vibrated with a simple configuration.

The vibration mechanisms 52 and 53 vibrate the bottom part 333 within a range so as not to create a gap through which the solid medicine M is discharged from the storage container 33. Therefore, a plurality of types (pieces) of the solid medicine M can be separated from each other on the bottom part 333 of the storage container 33 without undesirably dropping the solid medicine M through the created gap. Further, the moving direction of the bottom part 333 when opening and closing the lower opening 331*b* of the storage container 33 is the horizontal direction, and therefore the solid medicine M can be moved in the horizontal direction. Therefore, a plurality of types (pieces) of the solid medicine M can be more reliably separated from each other on the bottom part 333 of the storage container 33.

In this embodiment, the first vibration mechanism 52 and the second vibration mechanism 53 having different configurations are provided as the vibration mechanisms 52 and 53. There is no limitation to this example, and any one of the first vibration mechanism 52 and the second vibration mechanism 53 can be provided alone as a vibration mechanism.

First Vibration Mechanism

Figure 13:
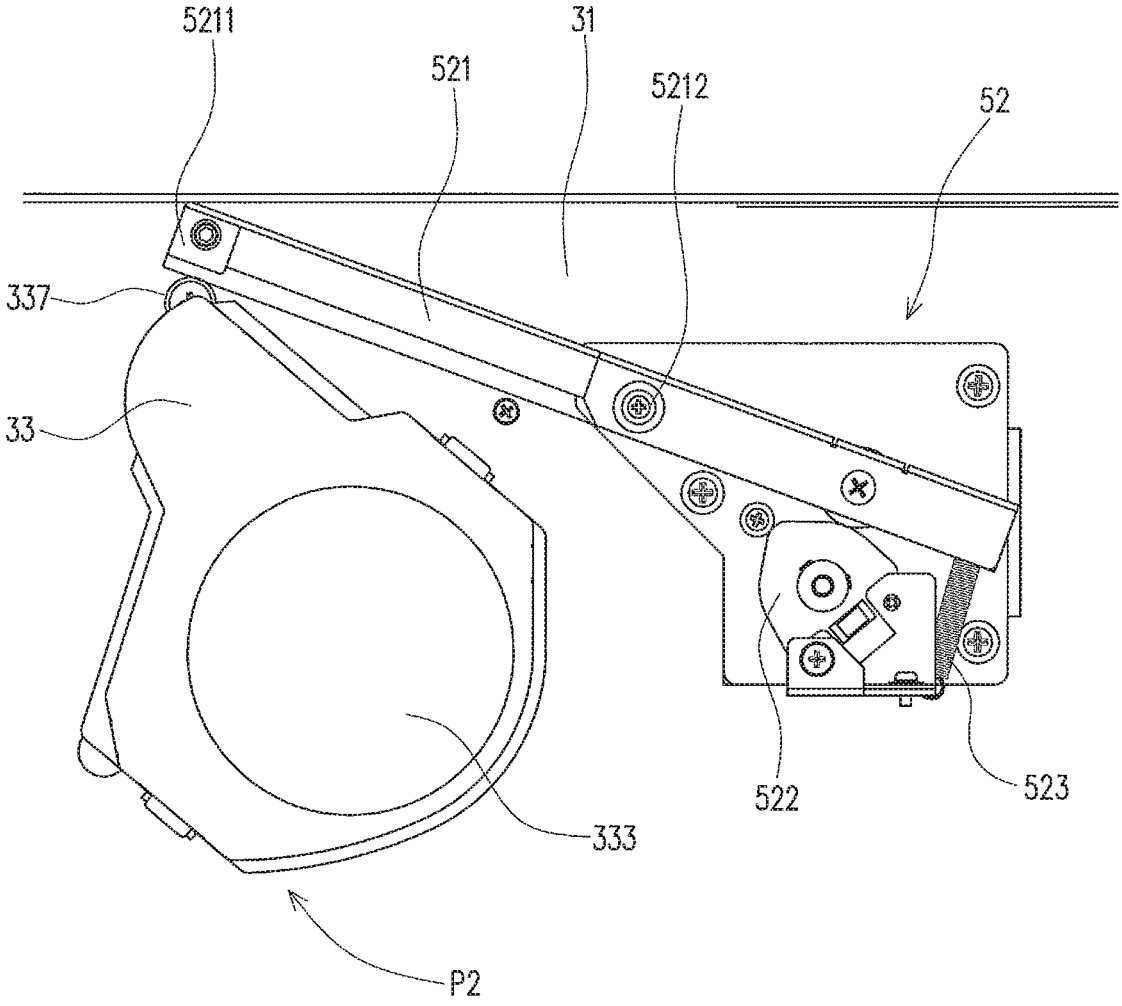
FIG. 13 is a plan view showing a first vibration mechanism of the medicine packaging apparatus in the state where the holding table is omitted.

The first vibration mechanism 52 is provided on the base 31 of the storage 3 and vibrates the bottom part 333 of each storage container 33 that has arrived at the shooting position P2. As shown in FIG. 13, the first vibration mechanism 52 includes a rocking bar 521 supported by the base 31 so as to be pivotable within a specific range. The lateral part on the storage container 33 side at the distal end of the rocking bar 521 serves as the pressing part 5211, which presses the pressed part 337 of the storage container 33 located at the shooting position P2. A rotating cam 522 abuts the proximal end of the rocking bar 521, so that the rocking bar 521 can be rocked by the rotation of the cam 522 within the specific range with a pivot center 5212 serving as the center. Further, a spring 523 is attached to the proximal end of the rocking bar 521 and biases the rocking bar 521 toward a direction in which the pressing part 5211 is moved away from the pressed part 337 of the storage container 33. With the rotation of the cam 522, the pressing part 5211 is moved to come close to the pressed part 337 of the storage container 33 against the bias of the spring 523.

With the rocking of the rocking bar 521, the pressing part 5211 of the first vibration mechanism 52 is reciprocally moved relative to the pressed part 337 of the storage container 33. The pressing part 5211 is reciprocally moved to the pressed part 337 when the drive unit 35 that intermittently drives the holding table 32 is stopped. Thereby, the bottom part 333 can be reliably vibrated with a simple configuration.

Second Vibration Mechanism

The second vibration mechanism 53 is constituted by a plurality (three in this embodiment) of block-shaped bodies 531 provided on the base 31. As compared with the case where the vibration mechanism is provided in the holding table 32, the bottom part 333 of the storage container 33 can be vibrated with a simple configuration.

Figure 14:
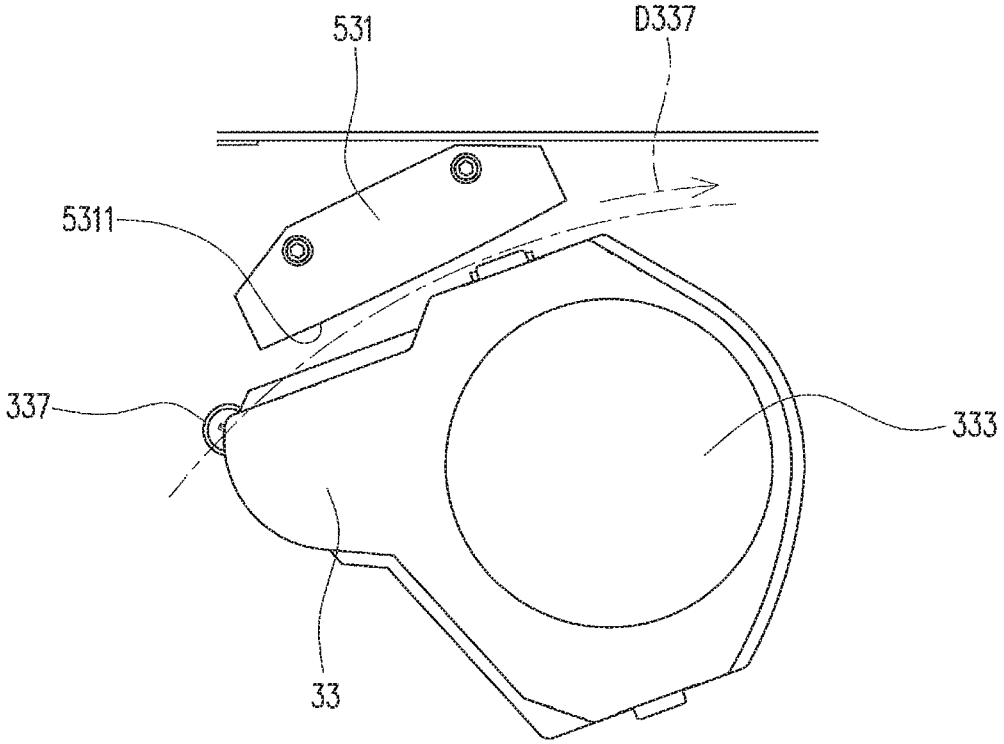
FIG. 14 is a plan view showing a second vibration mechanism of the medicine packaging apparatus in the state where the holding table is omitted.

With the rotation of the holding table 32, the inner surface (surface facing the holding table rotation axis L32) of each of the block-shaped bodies 531 becomes a surface abutting the pressed part 337 that is moving in a direction D337 shown in FIG. 14. The inner surface (abutting surface) abuts the pressed part 337 to function as a pressing part 5311 of the second vibration mechanism 53 that presses the pressed part 337 inwardly of the holding table 32. Therefore, the pressing part 5311 is arranged at a position so as to be capable of abutting the pressed part 337. The pressing part 5311 presses the pressed part 337 with the rotation of the holding table 32 by the drive unit 35. Therefore, a driving source provided only for vibration can be eliminated.

The pressed part 337 is pressed by the pressing part 5311, so that the bottom part 333 of the storage container 33 is moved. FIG. 14 shows a trajectory along which the center of the pressed part 337 moves in the direction D337 by a dashed-dotted line. As shown in the figure, the trajectory becomes closest to the pressing part 5311 at the center in the longitudinal direction of the pressing part 5311. Therefore, the bottom part 333 is located at the maximum movement position when the pressed part 337 abuts the center in the longitudinal direction of the pressing part 5311. As the holding table 32 rotates, and the storage containers 33 move on the inner side of the block-shaped bodies 531, the bottom part 333 moves to reach the maximum movement position and then to be returned to the original position.

The plurality (three points in this embodiment) of pressing parts 5311 are arranged at intervals along the moving path of the storage containers 33. Therefore, the plurality of pressing parts 5311 sequentially press the pressed parts 337 of the storage containers 33 with the rotation of the holding table 32, thereby vibrating the storage containers 33 multiple times (three times in this embodiment). Accordingly, a plurality of types (pieces) of the solid medicine M can be reliably separated from each other.

The plurality of block-shaped bodies 531 are arranged so that the pressing parts 5311 do not press the pressed parts 337 of two or more of the plurality of storage containers 33 in the same pressing state (specifically, with the same pressure) at any moment. That is, on the holding table 32, the arrangement intervals between the plurality of storage containers 33 are different from the arrangement intervals between the plurality of pressing parts 5311. For example, in the case of using three block-shaped bodies 531 as in this embodiment, the arrangement intervals can be set so that, when one of the three block-shaped bodies 531 is at the moment that the pressing part 5311 starts abutting the pressed part 337, another one is at the moment that the pressing part 5311 abuts the pressed part 337 with the bottom part 333 being located at the maximum movement position, and still another one is at the moment that the pressing part 5311 does not abut the pressed part 337. Therefore, the bottom parts 333 of two or more of the storage containers 33 are not subjected to the same pressure, thereby preventing the same vibration state. Accordingly, the load applied to the drive unit 35 can be reduced.

Summary of Vibration Mechanisms

As described above, the storage containers 33 include the pressed parts 337 and the biasing parts 336, and the vibration mechanisms 52 and 53 respectively include the pressing parts 5211 and 5311 configured to press the pressed parts 337 of the storage containers 33. The pressed parts 337 are pressed by the pressing parts 5211 and 5311, and thereby the bottom parts 333 of the storage containers 33 are moved toward the open direction (the other of the specific vibration directions) that is a direction in which the bottom parts 333 are in the open state against the biasing force by the biasing parts 336. Therefore, when the pressure to the pressed parts 337 by the pressing parts 5211 and 5311 is released, the bottom parts 333 of the storage containers 33 are moved toward the closing direction (one of the specific vibration directions) by the biasing force of the biasing part 336. Thus, the bottom parts 333 can be vibrated with a simple configuration.

Determination Unit

The determination unit 54 performs determination for the monitoring based on the image obtained by the imaging unit 51. Specifically, the determination unit 54 determines whether or not the solid medicine M inside each of the plurality of storage containers 33 matches the prescription data. As a method for the determination, a known image recognition method can be used. The determination unit 54 can be provided separately from the control unit 43 of the storage container detecting unit 4 or can be provided together within the control unit of the medicine packaging apparatus 1, for example.

The embodiments of the present invention have been described above but are just examples. The present invention is not limited to the aforementioned embodiments, and various modifications can be made without departing from the gist of the present invention.

For example, the medicine packaging apparatus 1 of the aforementioned embodiments includes the monitoring unit 5 that performs image monitoring, but the monitoring unit 5 can be omitted.

Further, the holding table 32 of the aforementioned embodiments is provided on the base 31 so as to be rotatable about a predetermined axis (the holding table rotation axis L32), but there is no limitation to this configuration. That is, the medicine packaging apparatus 1 can be configured to include the holding table 32 that is configured to hold the plurality of storage containers 33 at intervals on a predetermined imaginary line so as to be individually detachable and is provided to be movable with respect to the base 31 so that the held storage containers 33 can be moved (not rotated) along the imaginary line, the detection unit (the sensor 42) that is provided on the base 31 and is configured to detect the detection target 41 of the storage container 33 that has arrived at the detection position on the imaginary line, and the control unit 43 that is configured to rotate the holding table 32 by the drive unit 35 and determines whether or not the storage containers 33 are normally held by the holding table 32 based on the detection results by the detection unit (the sensor 42). The shape of the imaginary line is circular with the holding table rotation axis L32 serving as the center in the aforementioned embodiments, but it can be a linear or curved.

Figure 15A:
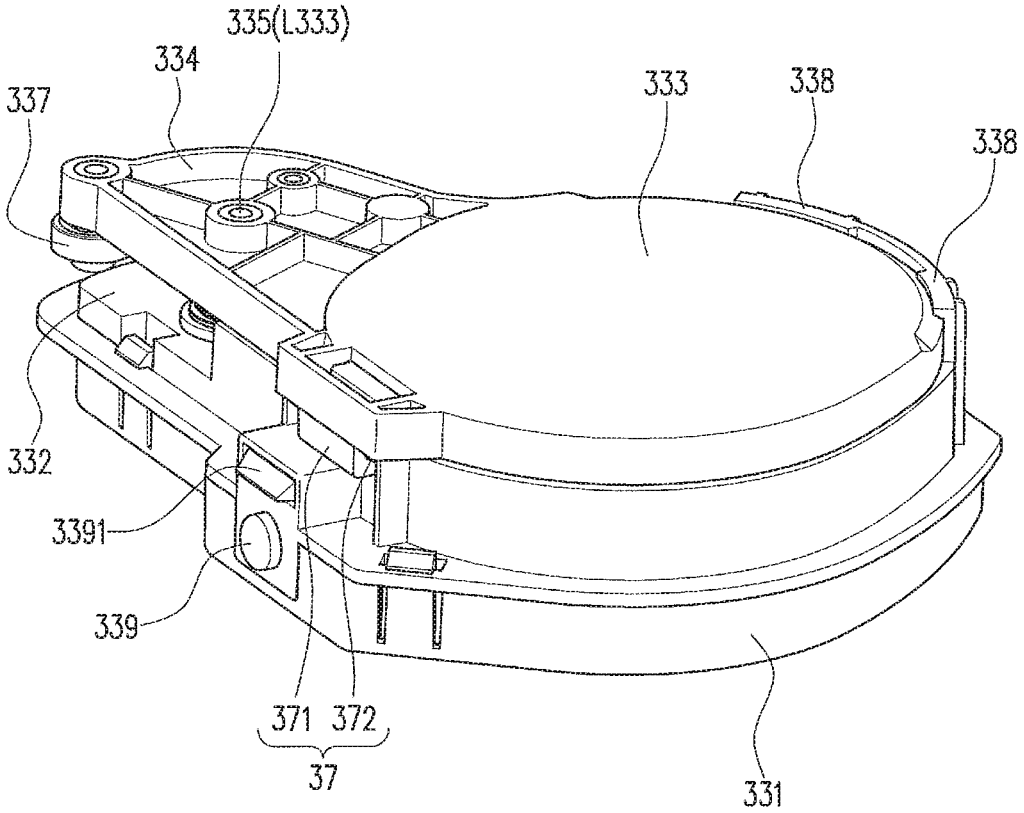
FIG. 15A is an upside-down perspective view showing a storage container of another embodiment of the medicine packaging apparatus.
Figure 15B:
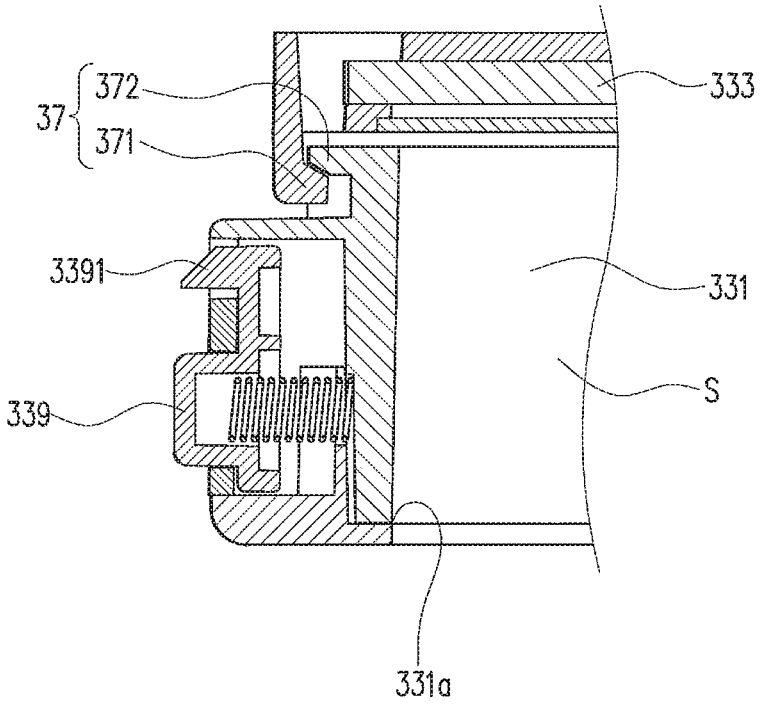
FIG. 15B is an enlarged sectional view showing a main part of another support part of a storage container of another embodiment of the medicine packaging apparatus.

Further, another support part 37 configured to support the bottom part 333 so as to suppress downward displacement can be provided, in addition to the support part 338. For example, as shown in FIG. 15A and FIG. 15B, the other support part 37 is formed on the end edges of the frame 331 and the bottom part 333 on the opposite side of the support part 338 in the pivot directions when in the opening and closing of the bottom part 333. The other support part 37 in this example is constituted by an engaging part 371 formed in the bottom part 333 and an engagement receiving part 372 formed in the frame 331. As shown in FIG. 15B, the engaging part 371 has an L-shaped cross section, that is, the engaging part 371 is a portion extending upwardly from the vicinity of the circumferential edge of the bottom part 333 and thereafter extending inwardly from the upper end. The engagement receiving part 372 is a portion extending outwardly from the frame 331. The other support part 37 in this example is formed to be displaced outwardly of the outer circumferential edge of the bottom part 333, but there is no limitation to this configuration, and various configurations can be employed as long as the configuration is such that the bottom part 333 is supported by engagement between the frame 331 and the bottom part 333.

Thus, by providing the other support part 37 in addition to the support part 338, the gap in the vertical direction between the frame 331 and the bottom part 333 can be reduced in the closing state. Therefore, leakage of the solid medicine M can be further reliably prevented, as compared with the case where only the support part 338 is provided.

Finally, the configuration and action of the aforementioned embodiment (including the modifications) will be summarized. The medicine packaging apparatus 1 according to the aforementioned embodiments configured to package medicine based on prescription data includes: a feeder 2 configured to feed solid medicine M; a storage 3 configured to temporarily store the solid medicine M fed from the feeder 2; and a packaging unit 6 configured to package the solid medicine M discharged from the storage 3, wherein the storage 3 includes: a plurality of storage containers 33; a holding table 32 configured to hold the plurality of storage containers 33 so as to be individually detachable; and a drive unit 35 configured to drive the holding table 32 to move so that the plurality of storage containers 33 held by the holding table 32 are moved between the introduction position P1 where the solid medicine M is introduced from the feeder 2 and the discharge position P3 where the solid medicine M is discharged to the packaging unit 6.

According to the aforementioned configuration, the plurality of storage containers 33 can be individually attached or detached, and cleaning can be performed while the plurality of storage containers 33 are detached. Therefore, cleaning of the plurality of storage containers 33 can be facilitated.

Further, the configuration can be such that each of the plurality of storage containers 33 includes: a bottom part 333 that is movable between an open state in which downward communication is possible and a closing state in which the communication is impossible; and a maintaining unit configured to maintain the bottom part 333 in the closing state when each of the plurality of storage containers 33 is detached from the holding table 32.

According to the aforementioned configuration, when each of the plurality of storage containers 33 is detached from the holding table 32, the bottom part 333 can be maintained in the closing state by the maintaining unit, and thus the residue remaining inside each of the plurality of storage containers 33 does not fall down into the medicine packaging apparatus 1.

Further, the configuration can be such that the maintaining unit includes a biasing part 336 configured to bias the bottom part toward a direction so as to be in the closing state.

Thus, the bottom part 333 can be maintained in the closing state with a simple configuration.

Further, the configuration can be such that each of the plurality of storage containers 33 includes an opening 331*a* that is open upward, and each of the plurality of storage containers 33 is detached from the holding table 32 with the opening 331*a* facing upward.

According to the aforementioned configuration, the residue remaining inside each of the plurality of storage containers 33 is less likely to fall down into the medicine packaging apparatus 1.

Further, the configuration can be such that each of the plurality of storage containers 33 is configured to be held in an engaged state with the holding table 32 and includes a pair of operation pieces 339 that are located on both sides with the opening 331*a* being interposed therebetween and are operated by an operator so as to be pinched from both sides inwardly of the opening 331*a*, and the engaged state of each of the plurality of storage containers 33 with the holding table 32 is released by operating the pair of operation pieces 339.

According to the aforementioned configuration, when releasing the engagement, the hand of the operator covers over the opening 331*a*, and therefore the residue remaining inside each of the plurality of storage containers 33 is further less likely to fall down.

Further, the configuration can be such that the feeder 2, the storage 3, and the packaging unit 6 are sequentially arranged from the top, the storage 3 is drawable in the horizontal direction from the housing 11, and each of the plurality of storage containers 33 is detached from the holding table 32 by being moved upwardly.

According to the aforementioned configuration, the storage 3 is located at an intermediate position that is not excessively high or low in the medicine packaging apparatus 1, and therefore it is easy to draw the storage 3, and it is easy to attach or detach each of the plurality of storage containers 33. Therefore, cleaning of the plurality of storage containers 33 can be facilitated.

Further, the medicine feeding apparatus according to the aforementioned embodiments configured to feed medicine based on prescription data includes: a feeder 2 configured to feed solid medicine M; and a storage 3 configured to temporarily store the solid medicine M fed from the feeder 2, wherein the storage 3 includes: a plurality of storage containers 33; a holding table 32 configured to hold the plurality of storage containers 33 so as to be individually detachable; and a drive unit 35 configured to drive the holding table 32 to move so that the plurality of storage containers 33 held by the holding table 32 are moved between the introduction position P1 where the solid medicine M is introduced from the feeder 2 and the discharge position P3 where the solid medicine M is discharged.

According to the aforementioned configuration, the plurality of storage containers 33 can be individually attached or detached, and cleaning can be performed while the plurality of storage containers 33 are detached. Therefore, cleaning of the plurality of storage containers 33 can be facilitated.

As described above, in the medicine packaging apparatus 1 and the medicine feeding apparatus according to the aforementioned embodiments, the plurality of storage containers 33 can be individually attached or detached, and cleaning can be performed while the plurality of storage containers 33 are detached. Accordingly, the medicine packaging apparatus 1 and medicine feeding apparatus which can facilitate cleaning can be provided.

REFERENCE SIGNS LIST

1: Medicine packaging apparatus
11: Housing
2: Feeder
3: Storage
31: Base
32: Holding table
33: Storage container
331: Frame
331*a*: Frame opening, Upper opening
332: Frame-side extending part
333: Bottom part
3331: Receiving part
3332: Holding part
3333: Reinforcing part
334: Bottom-side extending part
335: Coupler
336: Biasing part
3361: Coil
3362: Torsion coil spring member
3363: Frame-side locking tool
3364: Bottom-side locking tool
337: Pressed part
338: Support part
3381: Guide part
339: Operation piece
35: Drive unit
4: Storage container detecting unit
41: Detection target
42: Detection unit, Sensor
43: Control unit
5: Monitoring unit
51: Imaging unit
52: Vibration mechanism, First vibration mechanism
5211: Pressing part (First vibration mechanism)
53: Vibration mechanism, Second vibration mechanism
5311: Pressing part (Second vibration mechanism)
54: Determination unit
6: Packaging unit
P1: Introduction position
P2: Shooting position
P3: Discharge position
P4: Detection position
L32: Holding table rotation axis
L333: Bottom-part pivot axis
M: Medicine (Solid medicine)
S: Storage space

The invention claimed is:

1. A medicine packaging apparatus configured to package medicine based on prescription data, the medicine packaging apparatus comprising:

a feeder configured to feed solid medicine;

a monitoring unit configured to monitor the solid medicine fed from the feeder; and a packaging unit configured to package the solid medicine monitored by the monitoring unit, wherein the monitoring unit comprises:

a plurality of storage containers each configured to temporarily store the solid medicine fed from the feeder;

a holding table configured to hold the plurality of storage containers;

a drive unit configured to drive the holding table to move so that the plurality of storage containers are sequentially moved from an introduction position where the solid medicine is introduced from the feeder to a discharge position where the solid medicine is discharged to the packaging unit;

an imaging unit configured to capture an image of the solid medicine present in each of the plurality of storage containers while the each of the plurality of storage containers is moved from the introduction position to the discharge position; and a determination unit configured to perform determination for monitoring based on the image obtained by the imaging unit, wherein the plurality of storage containers are configured to be capable of being individually attached to or detached from the holding table;

each of the plurality of storage containers comprises an opening that is open upward;

each of the plurality of storage containers is detached from the holding table with the opening facing upward;

each of the plurality of storage containers is configured to be held in an engaged state with the holding table and further comprises an operation piece operated inwardly of the opening; and the engaged state of the storage container with the holding table is released by the operation of the operation piece.

2. The medicine packaging apparatus according to claim 1, wherein each of the plurality of storage containers comprises:

a bottom part that is movable between an open state in which downward communication is possible and a closing state in which the communication is impossible; and a maintaining unit configured to maintain the bottom part in the closing state when each of the plurality of storage containers is detached from the holding table.

3. The medicine packaging apparatus according to claim 2, wherein the maintaining unit comprises a biasing part configured to bias the bottom part toward a direction so as to be in the closing state.

4. The medicine packaging apparatus according to claim 1, further comprising a housing, wherein the feeder, the monitoring unit, and the packaging unit are arranged sequentially from the top in the housing, the holding table of the monitoring unit is drawable in the horizontal direction from the housing, and each of the plurality of storage containers is detached from the holding table by being moved upwardly in the state where the holding table of the monitoring unit is drawn out of the housing.

5. The medicine packaging apparatus according to claim 1, wherein the holding table is provided rotatably about an axis extending in a vertical direction, and configured to hold the plurality of storage containers at equal intervals on a circumference with the axis serving as the center on the same horizontal plane.

* * * * *